US009839924B2

(12) United States Patent
Mizushima et al.

(10) Patent No.: US 9,839,924 B2
(45) Date of Patent: Dec. 12, 2017

(54) FOAMER DISPENSER

(71) Applicants: Hiroshi Mizushima, Tokyo (JP); Tsuyoshi Sasaki, Tokyo (JP); Yasuhito Yamamoto, Tokyo (JP); Hiroyuki Kato, Tokyo (JP); Toshihiro Tashiro, Tokyo (JP)

(72) Inventors: Hiroshi Mizushima, Tokyo (JP); Tsuyoshi Sasaki, Tokyo (JP); Yasuhito Yamamoto, Tokyo (JP); Hiroyuki Kato, Tokyo (JP); Toshihiro Tashiro, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 113 days.

(21) Appl. No.: 14/898,305

(22) PCT Filed: Jul. 16, 2014

(86) PCT No.: PCT/JP2014/068898

§ 371 (c)(1),
(2) Date: Dec. 14, 2015

(87) PCT Pub. No.: WO2015/008785

PCT Pub. Date: Jan. 22, 2015

(65) Prior Publication Data

US 2016/0129459 A1 May 12, 2016

(30) Foreign Application Priority Data

Jul. 17, 2013 (JP) ..... 2013-148943
Jul. 17, 2013 (JP) ..... 2013-148944
(Continued)

(51) Int. Cl.
*B05B 7/00* (2006.01)
*B05B 11/00* (2006.01)
(Continued)

(52) U.S. Cl.
CPC ..... *B05B 7/0018* (2013.01); *A47K 5/14* (2013.01); *B05B 7/0037* (2013.01);
(Continued)

(58) Field of Classification Search
CPC ... B05B 7/0018; B05B 7/0037; B05B 7/0416; B05B 11/3087; B05B 11/02; B05B 11/3059; B05B 11/0075; A47K 5/14
(Continued)

(56) References Cited

U.S. PATENT DOCUMENTS 5,443,569 A * 8/1995 Uehira ..... B05B 7/0031 222/190
2009/0266846 A1* 10/2009 Lizuka ..... B05B 11/3087 222/190
(Continued)

FOREIGN PATENT DOCUMENTS

CN 2913241 Y 6/2007
JP 2000-107655 A 4/2000
(Continued)

OTHER PUBLICATIONS

Jan. 31, 2017 Office Action issued in Japanese Patent Application No. 2013-148946.
(Continued)

*Primary Examiner* — Paul R Durand
*Assistant Examiner* — Robert Nichols, II
(74) *Attorney, Agent, or Firm* — Oliff PLC

(57) ABSTRACT

In a foamer dispenser, a depressing head includes: a head main unit with a top wall portion arranged above the stem and with an attachment cylindrical portion that extends downwardly from the top wall portion and is attached to the stem; and an exterior cylindrical portion that is provided beneath the top wall portion and surrounds the attachment cylindrical portion and the guide cylindrical portion from an
(Continued)

outer side in a radial direction. An inside of the exterior cylindrical portion is communicable with an inside of the cylinder for air through an inside of the guide cylindrical portion. The head main unit and the exterior cylindrical portion are formed as separate entities and are fitted to each other. In an upper end portion of the exterior cylindrical portion, intake holes are formed that penetrate through the exterior cylindrical portion in a radial direction and open toward an upward direction.

5 Claims, 8 Drawing Sheets

(30) Foreign Application Priority Data

Jul. 17, 2013 (JP) ..... 2013-148945
Jul. 17, 2013 (JP) ..... 2013-148946

(51) Int. Cl.
*A47K 5/14* (2006.01)
*B05B 7/04* (2006.01)
*B05B 11/02* (2006.01)

(52) U.S. Cl.
CPC ..... *B05B 7/0416* (2013.01); *B05B 11/0064* (2013.01); *B05B 11/0075* (2013.01); *B05B 11/02* (2013.01); *B05B 11/3059* (2013.01); *B05B 11/3087* (2013.01)

(58) Field of Classification Search
USPC ..... 222/190
See application file for complete search history.

(56) References Cited

U.S. PATENT DOCUMENTS

2010/0006604 A1 1/2010 Ding
2013/0048755 A1* 2/2013 Uehira ..... B05B 11/0018 239/318
2013/0292420 A1 11/2013 Mizushima

FOREIGN PATENT DOCUMENTS

JP 3569384 B2 9/2004
JP 2009-050782 A 3/2009
JP 2009-202122 A 9/2009
JP 2010-227822 A 10/2010
JP 2011-213352 A 10/2011
JP 4868919 B2 2/2012
JP 2012-157820 A 8/2012
JP 2012-210949 A 11/2012
WO 97/42124 A1 11/1997

OTHER PUBLICATIONS

Mar. 1, 2017 Extended European Search Report issued in Patent Application No. 14825992.2.
Oct. 21, 2014 Search Report issued in International Patent Application No. PCT/JP2014/068898.
Oct. 4, 2016 Office Action issued in Japanese Patent Application No. 2013-148945.
Oct. 17, 2016 Office Action issued in Chinese Patent Application No. 201480040042.6.
May 16, 2017 Office Action issued in Japanese Patent Application No. 2013-148946.
May 9, 2017 Notice of Reasons for Rejection issued in Japanese Patent Application No. 2013-148945.

* cited by examiner

FOAMER DISPENSER

TECHNICAL FIELD

The present invention relates to a foamer dispenser.

Priority is claimed on Japanese Patent Application No. 2013-148943, filed on Jul. 17, 2013, Japanese Patent Application No. 2013-148944, filed on Jul. 17, 2013, Japanese Patent Application No. 2013-148945, filed on Jul. 17, 2013, and Japanese Patent Application No. 2013-148946, filed on Jul. 17, 2013, the contents of which are incorporated herein by reference.

BACKGROUND ART

Conventionally, a foamer dispenser described in, for example, Patent Document 1 below is known. This foamer dispenser includes: an attachment cap that is attached to a mouth portion of a container main unit in which a content substance is to be contained; a discharge device with a stem that is erected through the attachment cap so as to be movable downwardly while being biased upwardly; and a depressing head which is attached to the stem and in which a nozzle hole is formed.

The discharge device includes: a piston for liquid that is linked to the stem; a cylinder for liquid in which the piston for liquid is contained so as to be freely slidable in the up-down direction; a piston for air that is linked to the stem; and a cylinder for air in which the piston for air is contained so as to be freely slidable in the up-down direction. The discharge device further includes: an air-liquid mixing chamber that mixes liquid from the cylinder for liquid with air from the cylinder for air; and a foaming member that is disposed between the air-liquid mixing chamber and the nozzle hole and foams an air-liquid mixture from the air-liquid mixing chamber.

The attachment cap includes: an annular ceiling wall portion that is arranged above the mouth portion of the container main unit; and a guide cylindrical portion that is erected on an inner circumferential edge of the ceiling wall portion. The depressing head includes: a top wall portion that is arranged above the stem; an attachment cylindrical portion that extends downwardly from the top wall portion and is attached to the stem; and an exterior cylindrical portion that extends downwardly from the top wall portion and surrounds the attachment cylindrical portion and the guide cylindrical portion from the outer side in the radial direction. The inside of the exterior cylindrical portion is in communication with the inside of the cylinder for air through the inside of the guide cylindrical portion.

In the foamer dispenser with this structure, when the depressing head is depressed to move the stem downwardly against the biasing force, the discharge device is activated to cause a foam-like content substance to be discharged from the nozzle hole. After that, when the depressing of the depressing head is released to allow the biasing force to move back the depressing head together with the stem upwardly, the inside of the cylinder for air has a negative pressure. Then, the air is sucked into the exterior cylindrical portion from the outside of the foamer dispenser through a gap between the inner circumferential surface of the exterior cylindrical portion and the outer circumferential surface of the guide cylindrical portion (hereinafter, referred to as "cylinder-cylinder gap") and is subsequently drawn into the cylinder for air through the inside of the guide cylindrical portion.

CITATION LIST

Patent Documents

Patent Document 1: Japanese Unexamined Patent Application, First Publication No. 2009-202122

SUMMARY OF INVENTION

Technical Problem

However, in the conventional foamer dispenser as described above, if foreign matter such as water is attached to the external surface of the attachment cap, the foreign matter together with air may be sucked into the exterior cylindrical portion through the cylinder-cylinder gap when the depressing head is moved back upwardly. As a result, the foreign matter may intrude into the cylinder for air.

Furthermore, in the conventional foamer dispenser as described above, for example from the viewpoint of molding, there are cases where as for the depressing head, a connected body of the top wall portion and the attachment cylindrical portion (hereinafter, referred to as head main unit) and the exterior cylindrical portion are preferably formed as separate entities.

In this case, it is necessary to attach the exterior cylindrical portion tightly to the head main unit, to thereby prevent the exterior cylindrical portion from being removed due to a shock from being dropped or from shaking.

Furthermore, in the conventional foamer dispenser as described above, there are cases where some users depress the depressing head in an oblique direction. Therefore, it is desired that this oblique depressing be restricted.

In the conventional foamer dispenser as described above, for example from the viewpoint of molding, there are cases where as for the depressing head, the head main unit and the exterior cylindrical portion are preferably formed as separate entities. In this case, if the depressing head is depressed in an oblique direction, the positional relationship in the radial direction between the exterior cylindrical portion and the head main unit is likely to be unstable.

Furthermore, in the conventional foamer dispenser as described above, there are cases where a user depresses the depressing head while, for example, holding a nozzle cylindrical portion in which a discharge hole opens. In this case, there is a possibility that, as a result of being depressed obliquely with respect to the attachment cap, the discharge device is not allowed to be depressed straightly toward the downward direction. Therefore, it is desired that the oblique depressing of the discharge device be restricted.

The present invention has been achieved in view of the aforementioned circumstances, and has an object to provide a foamer dispenser that makes it possible to inhibit foreign matter such as water from intruding into a cylinder for air.

Furthermore, the present invention has been achieved in view of the aforementioned circumstances, and has an object to provide a foamer dispenser in which it is possible to attach an exterior cylindrical portion tightly to a head main unit.

Furthermore, the present invention has been achieved in view of the aforementioned circumstances, and has an object to provide a foamer dispenser in which it is possible to restrict an oblique depressing of a depressing head, to thereby stabilize the positional relationship in the radial direction between the exterior cylindrical portion and the head main unit.

Furthermore, the present invention has been achieved in view of these circumstances, and has an object to provide a foamer dispenser in which, when the depressing head is depressed, it is possible to inhibit a discharge device from being depressed obliquely with respect to an attachment cap and from shaking.

Solution to Problem

To solve the above problems, the present invention proposes the following.

A foamer dispenser according to a first aspect of the present invention includes: an attachment cap that is attached to a mouth portion of a container main unit in which a content substance is contained; a discharge device having a stem that is erected through the attachment cap so as to be movable downwardly while being biased upwardly; and a depressing head which is attached to the stem and in which a nozzle hole is formed, in which the discharge device includes: a piston for liquid that is linked to the stem; a cylinder for liquid in which the piston for liquid is contained so as to be freely slidable in an up-down direction; a piston for air that is linked to the stem; a cylinder for air in which the piston for air is contained so as to be freely slidable in the up-down direction; an air-liquid mixing chamber that mixes liquid from the cylinder for liquid with air from the cylinder for air; and a foaming member that is disposed between the air-liquid mixing chamber and the nozzle hole and foams an air-liquid mixture from the air-liquid mixing chamber, in which the attachment cap includes: an annular ceiling wall portion that is arranged above the mouth portion; and a guide cylindrical portion that is erected on the ceiling wall portion, in which the depressing head includes: a head main unit having a top wall portion arranged above the stem, and an attachment cylindrical portion that extends downwardly from the top wall portion and is attached to the stem; and an exterior cylindrical portion that is provided beneath the top wall portion and surrounds the attachment cylindrical portion and the guide cylindrical portion from an outer side in a radial direction, in which an inside of the exterior cylindrical portion is communicable with an inside of the cylinder for air through an inside of the guide cylindrical portion, in which the head main unit and the exterior cylindrical portion are formed as separate entities and are fitted to each other, and in which, in an upper end portion of the exterior cylindrical portion, an intake hole is formed that penetrates through the exterior cylindrical portion in the radial direction and opens toward an upward direction.

According to this invention, the intake hole is formed in the upper end portion of the exterior cylindrical portion. Therefore, when the depressing of the depressing head is released to cause the inside of the cylinder for air to have a negative pressure, it is possible to suck outside air into the exterior cylindrical portion through the intake hole. Consequently, it is possible to inhibit the outside air from being sucked into the exterior cylindrical portion through a gap between an inner circumferential surface of the exterior cylindrical portion and an outer circumferential surface of the guide cylindrical portion (hereinafter, referred to as "cylinder-cylinder gap"), and hence, to inhibit foreign matter together with the outside air from being sucked into the exterior cylindrical portion through the cylinder-cylinder gap. As a result, it is possible to inhibit the intrusion of foreign matter into the cylinder for air.

Furthermore, the intake hole is formed in the upper end portion of the exterior cylindrical portion. Therefore, it is possible to maintain a low influence that the intake hole has on the appearance of the depressing head.

Furthermore, the intake hole opens toward the upward direction. Therefore, for example, when the exterior cylindrical portion is molded with a mold, it is possible to remove the mold with ease, and hence, to make it easy to form the foamer dispenser in a simplified manner.

In the foamer dispenser according to the first aspect of the present invention, in an opening circumferential edge of the intake hole in an outer circumferential surface of the exterior cylindrical portion, a receding section may be formed that recedes inwardly in the radial direction and is in communication with the intake hole.

In this case, the receding sections are formed in the opening circumferential edges of the intake holes in the outer circumferential surface of the exterior cylindrical portion. This makes it difficult for foreign matter such as water to intrude. Furthermore, it is possible to introduce outside air into the intake holes through the receding sections, and hence, to effectively suck the outside air into the exterior cylindrical portion through the intake holes.

In the foamer dispenser according to the first aspect of the present invention, the head main unit may be provided with a covering wall portion that extends downwardly from the top wall portion and covers the intake hole from an outer side in the radial direction.

In this case, the head main unit includes the covering wall portion. Therefore, it is possible to inhibit the intake holes from being exposed to the outside, and hence, to maintain the appearance of the foamer dispenser favorable.

In the foamer dispenser according to the first aspect of the present invention, the top wall portion may be provided with a pair of lock portions that protrude downwardly, are spaced in a circumferential direction, and are locked between parts of an inner circumferential edge of the intake hole that face inwardly in the circumferential direction.

In this case, the top wall portion is provided with the pair of lock portions. Therefore, when the head main unit and the exterior cylindrical portion are to rotate relatively to each other in the circumferential direction, the lock portions are locked in the inner circumferential edges of the intake holes, to thereby make it possible to restrict the rotation. Furthermore, when the exterior cylindrical portion is to be deformed so that the intake holes are narrowed in the circumferential direction, the lock portions are locked in the inner circumferential edges of the intake holes. Thereby, it is possible to restrict the deformation.

Furthermore, the pair of lock portions is spaced in the circumferential direction. Therefore, while the rotation and deformation as described above are being restricted, it is possible to securely bring the inside and outside of the exterior cylindrical portion into communication with each other through a part of the intake hole that is located between the pair of lock portions, and hence, to securely suck the outside air into the exterior cylindrical portion through the intake hole.

If the top wall portion is provided with the fitting cylindrical portion that protrudes downwardly and that is fitted onto the attachment cylindrical portion, and the lock portions connect between the attachment cylindrical portion and the fitting cylindrical portion, then when the lock portions are locked in the inner circumferential edges of the intake holes, it is possible to support both ends of the lock portions in the radial direction by means of the attachment cylindrical portion and the fitting cylindrical portion. Therefore, it is possible to effectively restrict the aforementioned rotation and deformation.

In the foamer dispenser according to the first aspect of the present invention, the top wall portion may be provided with a plurality of support plate portions that protrude downwardly, extend in the radial direction, and are arranged in the circumferential direction; inner ends of the support plate portions in the radial direction are connected to the attachment cylindrical portion; and outer ends of the support plate portions in the radial direction support the exterior cylindrical portion from an inner side in the radial direction.

In this case, the plurality of support plate portions are arranged in the top wall portion, and moreover, the ends of the support plate portions on the inner side in the radial direction are connected to the attachment cylindrical portion while the ends of the support plate portions on the outer side in the radial direction support the exterior cylindrical portion from the inner side in the radial direction. Therefore, for example, when the exterior cylindrical portion is about to shake in the radial direction with respect to the head main unit, it is possible to cause the top wall portion and the attachment cylindrical portion to support the exterior cylindrical portion via the support plate portions. As a result, it is possible to attach the exterior cylindrical portion tightly to the head main unit. Therefore, for example, it is possible to inhibit shaking between the exterior cylindrical portion and the head main unit.

In the foamer dispenser according to the first aspect of the present invention, the top wall portion may be provided with a fitting cylindrical portion that protrudes downwardly and is fitted onto the attachment cylindrical portion.

In this case, the top wall portion is provided with the fitting cylindrical portion. This makes it possible to sandwich the exterior cylindrical portion between the support plate portions and the fitting cylindrical portion in the radial direction. Therefore, it is possible to attach the exterior cylindrical portion further tightly to the head main unit.

In the foamer dispenser according to the first aspect of the present invention, the lock portion may be formed in a plate shape that extends in the radial direction and an end thereof in the radial direction is connected to the attachment cylindrical portion; and an in-cylinder portion of the lock portion that is located on a more inner side than the exterior cylindrical portion in the radial direction may protrude further downwardly than a part of the lock portion that is located in the intake hole and may support the exterior cylindrical portion from the inner side in the radial direction.

In this case, the in-cylinder portions of the lock portions support the exterior cylindrical portion from the inner side in the radial direction. This makes it possible to support the exterior cylindrical portion from the inner side in the radial direction not only by the support plate portions but also by the in-cylinder portions of the lock portions. Therefore, it is possible to attach the exterior cylindrical portion further tightly to the head main unit.

In the foamer dispenser according to the first aspect of the present invention, an inner circumferential surface of the exterior cylindrical portion may be protrudingly provided with guide ribs that extend in the up-down direction.

In this case, the guide ribs are protrudingly provided on the inner circumferential surface of the exterior cylindrical portion. Therefore, for example, when the depressing head is obliquely depressed, the guide cylindrical portion is made slidable on the guide ribs, in the up-down direction, and hence, it is possible to restrict the displacement of the exterior cylindrical portion in the radial direction by means of the guide cylindrical portion. As a result, it is possible to stabilize the position of the exterior cylindrical portion in the radial direction. Consequently, it is possible to stabilize the positional relationship between the exterior cylindrical portion and the head main unit in the radial direction.

In the foamer dispenser according to the first aspect of the present invention, the guide ribs may be arranged in sections of the exterior cylindrical portion that are opposite to each other across the guide cylindrical portion.

In this case, the guide ribs are arranged in the sections of the exterior cylindrical portion that are opposite to each other in the radial direction across the guide cylindrical portion. Therefore, when the depressing head is obliquely depressed, the guide ribs are made capable of slidably contacting the guide cylindrical portion from both outer sides in the radial direction. Consequently, it is possible to further stabilize the position of the exterior cylindrical portion in the radial direction.

In the foamer dispenser according to the first aspect of the present invention, the head main unit may include a nozzle cylindrical portion which extends outwardly in the radial direction from the attachment cylindrical portion to protrude more outwards in the radial direction than the exterior cylindrical portion and a protrusion end of which is provided with the nozzle hole, and the guide rib may include: a first guide rib that is arranged in a part of the exterior cylindrical portion that is positionally equivalent to the nozzle cylindrical portion in the circumferential direction; and a second guide rib that is arranged in a part opposite to the first guide rib in the radial direction across the guide cylindrical portion.

The head main unit includes the nozzle cylindrical portion. For example, in the case where the depressing head is depressed with the nozzle cylindrical portion being held, the depressing head is likely to be depressed obliquely. Consequently, the positional relationship between the exterior cylindrical portion and the head main unit is likely to be unstable in the forward-rearward direction, which is a direction in which the nozzle cylindrical portion extends.

Here, the first guide rib and the second guide rib are arranged in the sections of the exterior cylindrical portion that are located on both sides in the forward-rearward direction. Therefore, when the depressing head is obliquely depressed, it is possible to stabilize the position of the exterior cylindrical portion in the forward-rearward direction by means of the first guide rib and the second guide rib. Therefore, it is possible to securely stabilize the positional relationship between the exterior cylindrical portion and the head main unit in the forward-rearward direction.

A foamer dispenser according to a second aspect of the present invention includes: an attachment cap that is attached to a mouth portion of a container main unit in which a content substance is contained; and a discharge device that has a stem erected through the attachment cap so as to be movable downwardly while being biased upwardly and that has a depressing head which is attached to the stem and in which a discharge hole is formed, in which the discharge device includes: a piston for liquid that moves in an up-down direction in conjunction with the stem; a cylinder for liquid in which the piston for liquid is disposed so as to be slidable in the up-down direction; a piston for air that moves in the up-down direction in conjunction with the stem; a cylinder for air in which the piston for air is disposed so as to be slidable in the up-down direction; an air-liquid mixing chamber that mixes a liquid content transferred from the cylinder for liquid with air transferred from the cylinder for air; and a foaming member that is disposed between the air-liquid mixing chamber and the discharge hole and foams an air-liquid mixture having been mixed in the air-liquid mixing chamber, in which the attachment cap includes a guide portion through which the discharge device is inserted in the up-down direction, and in which either one of an outer circumferential surface of an insertion section of the discharge device that is inserted through the guide portion and an inner circumferential surface of the guide portion is provided with guide ribs that are slidable in the up-down direction with respect to the other.

According to the foamer dispenser of the second aspect of the present invention, either one of the outer circumferential surface of the insertion section of the discharge device that is inserted through the guide portion of the attachment cap and the inner circumferential surface of the guide portion of the attachment cap is provided with the guide ribs that are slidable in the up-down direction with respect to the other. Therefore, even if, when the depressing head is depressed, the discharge device does not move straightly toward the downward direction but is to move in a direction that crosses the up-down direction, the guide ribs move up and down while sliding on the circumferential surface of the other. As a result, it is possible to inhibit the discharge device from being depressed obliquely forwardly or rearwardly instead of straightly downwardly and from shaking with respect to the attachment cap.

From above, when the depressing head is depressed, it is possible to inhibit the oblique depressing or shaking (hereinafter, sometimes referred to shortly as shaking or the like) of the discharge device with respect to the attachment cap, and hence, to stabilize the positional relationship between the discharge device and the attachment cap in the radial direction. This stabilizes the operation of depressing. Therefore, operability of the foamer dispenser is enhanced.

In the foamer dispenser according to the second aspect of the present invention, the piston for air may include an inner slide cylinder, the stem may be inserted into the inner slide cylinder so as to be movable in the up-down direction, the guide portion may include: an annular ceiling wall portion which is arranged above the mouth portion and through which the stem is inserted; and a guide cylindrical portion that is erected on an inner circumferential edge of the ceiling wall portion, and the guide ribs may include third guide ribs that are provided on either one of the inner slide cylinder and the ceiling wall portion so as to be slidable with respect to the other.

In this case, as guide ribs, the third guide ribs, which are slidable with respect to the other in the up-down direction, are provided with either one of the inner slide cylinder of the piston for air and the ceiling wall portion of the attachment cap. Therefore, shaking or the like when the piston for air of the discharge device is moved up and down with respect to the ceiling wall portion of the attachment cap is inhibited. Consequently, the aforementioned effect is further enhanced.

In the foamer dispenser according to the second aspect of the present invention, the ceiling wall portion may be provided with an insertion cylinder into which the inner slide cylinder is inserted.

In this case, it is possible to obtain a length along the up-down direction that is sufficiently long to allow the insertion cylinder of the ceiling wall portion and the inner slide cylinder of the piston for air to contact each other. Consequently, the aforementioned effect of inhibiting shaking or the like of the discharge device is further enhanced.

In the foamer dispenser according to the second aspect of the present invention, the third guide ribs may be provided on the inner slide cylinder.

Through the inner slide cylinder of the piston for air, the stem is inserted. The inner slide cylinder and the stem are inserted into the ceiling wall portion of the attachment cap. In the case of this structure, it is possible to obtain a more sufficient length of the third guide rib along the up-down direction. Consequently, the aforementioned effect of inhibiting shaking or the like of the discharge device is further enhanced.

In the foamer dispenser according to the second aspect of the present invention, the depressing head may include: a top wall portion that is arranged above the stem; and an attachment cylindrical portion that protrudes downwardly from the top wall portion and is attached to the stem, and the guide ribs may include fourth guide ribs that are provided on either one of the attachment cylindrical portion and the guide cylindrical portion so as to be slidable with respect to the other.

In this case, as guide ribs, the fourth guide ribs, which are slidable in the up-down direction with respect to the other, are provided with either one of the attachment cylindrical portion of the depressing head and the guide cylindrical portion of the attachment cap. Therefore, shaking or the like when the depressing head of the discharge device is moved in the up-down direction with respect to the guide cylindrical portion of the attachment cap is inhibited. Consequently, the aforementioned effect is further enhanced.

Furthermore, in this case, the third guide ribs and the fourth guide ribs are allowed to be located in different sections along the up-down direction (allowed to be spaced in the up-down direction). Therefore, it is possible to inhibit the aforementioned shaking or the like of the discharge device especially remarkably.

Advantageous Effects of Invention

According to the foamer dispenser of the present invention, it is possible to inhibit foreign matter such as water from intruding into the cylinder for air.

Furthermore, according to the foamer dispenser of the present invention, with the exterior cylindrical portion being attached tightly to the head main unit, it is possible to prevent the exterior cylindrical portion from being removed due to shock from being dropped down and from shaking.

Furthermore, according to the foamer dispenser of the present invention, it is possible to restrict the oblique depressing of the depressing head, to thereby stabilize the positional relationship in the radial direction between the exterior cylindrical portion and the head main unit.

Furthermore, according to the foamer dispenser of the present invention, when the depressing head is depressed, it is possible to inhibit the discharge device from being depressed obliquely with respect to the attachment cap and from shaking.

DESCRIPTION OF EMBODIMENTS (First Embodiment)

Hereunder is a description of a foamer dispenser 10 according to a first embodiment of the present invention, with reference to FIG. 1 to FIG. 7.

The foamer dispenser 10 transforms the content substance (content liquid) thereof into a bubble form and discharges it. As the content substance, for example a skin wash fluid (body-wash) may be listed. A table of components of an exemplary content substance is shown in Table 1 below.

TABLE 1

| Component | Mass % |
|---|---|
| Sodium lauriminopropionate | 3 |
| Lauramidopropyl betaine | 20 |
| N-sodium methyl cocoyl taurate | 2 |
| Polyoxyethylene(2)alkyl(12-14)sulfosuccinate disodium | 10 |
| Sorbitol | 3 |
| Glycerin | 3 |
| Propylene glycol | 20 |
| Sodium benzoate | 0.9 |
| Citric acid | 0.7 |
| Honey | 0.1 |
| DL-sodium pyrrolidone carboxylate solution | 0.1 |
| Dye | 0.01 |
| Purified water | Balance |

Figure 1:
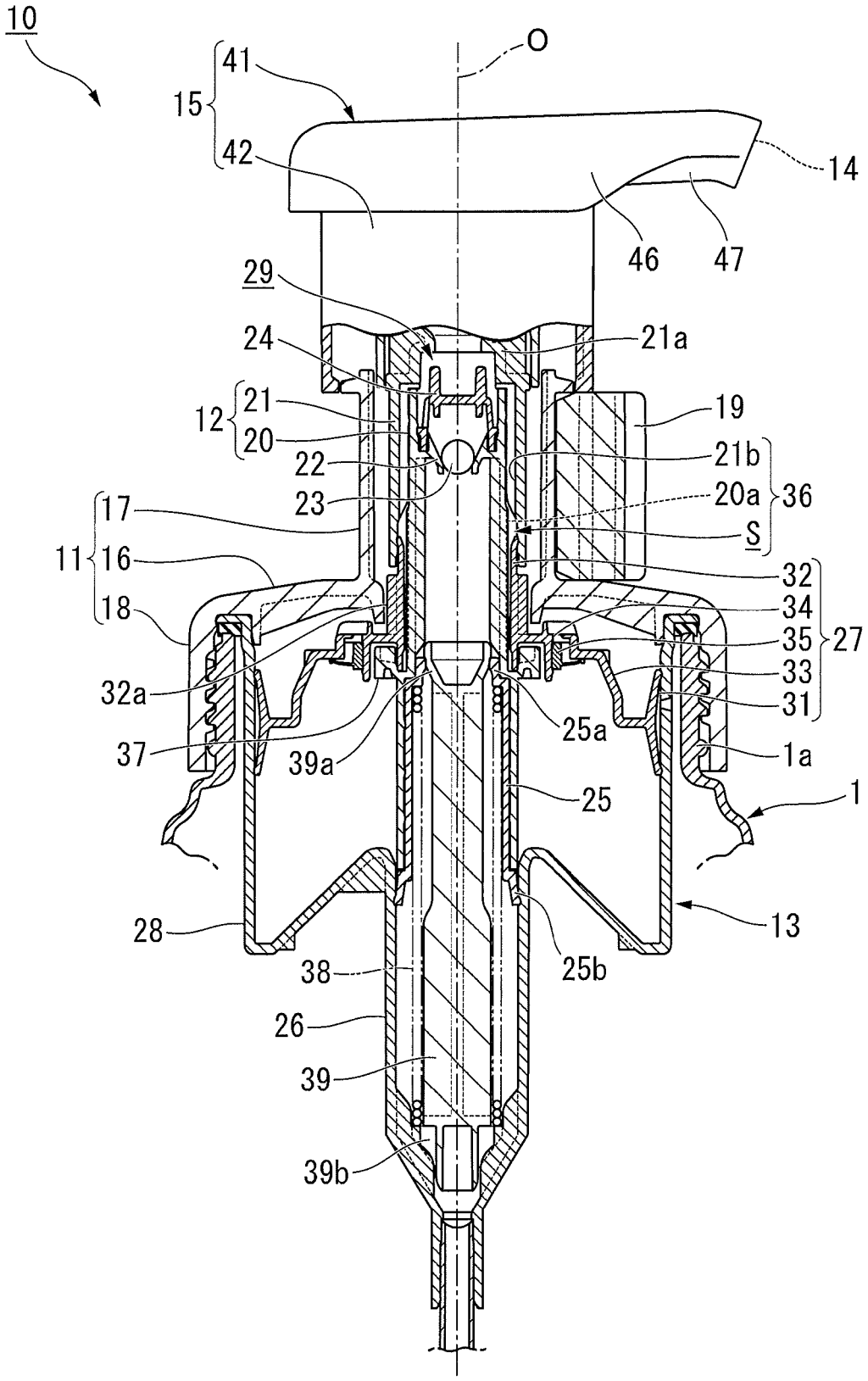
FIG 1 is a partial longitudinal cross-sectional view of a foamer dispenser according to a first embodiment of the present invention.
Figure 2:
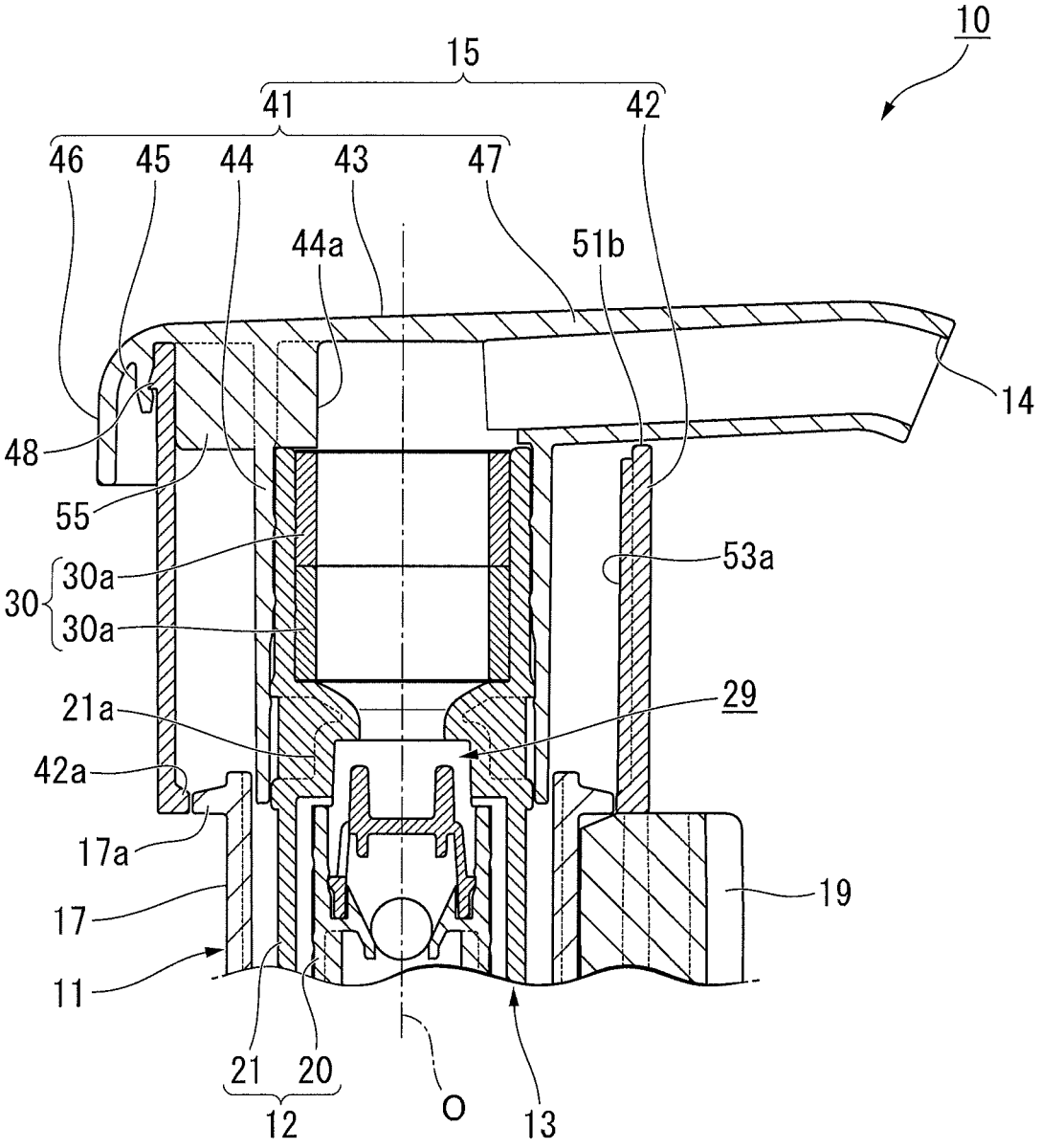
FIG. 2 is a longitudinal cross-sectional view of the main part of the foamer dispenser shown in FIG. 1.

As shown in FIG. 1 and FIG. 2, the foamer dispenser 10 includes: an attachment cap 11 that is attached to a mouth portion 1*a* of a container main unit 1 in which a content substance is contained; a discharge device 13 with a stem 12 that is erected through the attachment cap 11 so as to be slidable downwardly while being biased upwardly; and a depressing head 15 which is attached to the stem 12 and in which a nozzle hole 14 is formed.

The attachment cap 11 is formed in a cylindrical shape opening at the top and bottom thereof. The depressing head 15 is formed in a cylindrical shape with a top. The central axis lines of the attachment cap 11, the stem 12, and the depressing head 15 are located on a common axis. Hereinafter, the common axis is referred to as axis line O. A direction along the axis line O is referred to as up-down direction. A side on the depressing head 15 along the up-down direction is referred to as upper side while a side opposite thereto is referred to as lower side. A direction orthogonal to the axis line O is referred to as radial direction. A direction about the axis line O is referred to as circumferential direction.

The attachment cap 11 includes: an annular ceiling wall portion 16 arranged above the mouth portion 1*a* of the container main unit 1; a guide cylindrical portion 17 that is erected on an inner circumferential edge of the ceiling wall portion 16; and an attachment circumferential wall portion 18 which extends downwardly from an outer circumferential edge of the ceiling wall portion 16 and which is attached to the mouth portion la. Note that the mouth portion la and the attachment circumferential wall portion 18 are fitted to each other by, for example, screwing, undercut, or the like.

On an upper end portion of the guide cylindrical portion 17, an inner guide protrusion 17*a* is provided that protrudes outwardly in the radial direction. The inner guide protrusion 17*a* is formed in an annular shape. To the part of the guide cylindrical portion 17 that is located on the side lower than the inner guide protrusion 17*a*, a restricting member 19 is freely detachably attached that has a C shape when seen in a planar view and restricts the depressing of the depressing head 15.

The stem 12 is inserted through the attachment cap 11. The stem 12 includes: a lower stem 20: and an upper stem 21.

An upper end portion of the lower stem 20 is arranged inside the guide cylindrical portion 17. On an inner circumferential surface of the upper end portion of the lower stem 20, an annular valve seat 22 is provided that protrudes inwardly in the radial direction. To the valve seat 22, a liquid discharge valve 23 with a spherical shape is seatably and detachably provided.

Inside the upper end portion of the lower stem 20, a presser member 24 is provided that is formed via a plurality of support pillars extending in the up-down direction. The support pillars are arranged inside the upper end portion of the lower stem 20 so as to be spaced from each other in the circumferential direction. Lower end portions of the support pillars are located on the valve seat 22. Between the adjacent support pillars, a circulation hole is provided.

A lower end portion of the upper stem 21 is fitted onto the upper end portion of the lower stem 20. The upper stem 21 is inserted into the guide cylindrical portion 17 of the attachment cap 11 so as to be freely movable in the up-down direction. In an intermediate part of the upper stem 21 that is located between the lower end portion and the upper end portion, a reduced-diameter part 21*a* is formed. In an inner circumferential surface of the lower end portion of the upper stem 21, a plurality of longitudinal grooves 21*b* are formed that extend in the up-down direction. An upper end portion of the longitudinal groove 21*b* opens in an inner side in the radial direction while a lower end portion of the longitudinal groove 21*b* opens in a downward direction.

The discharge device 13 further includes: a piston for liquid 25 that is linked to the stem 12; a cylinder for liquid 26 in which the piston for liquid 25 is contained so as to be freely slidable in the up-down direction; a piston for air 27 that is linked to the stem 12; a cylinder for air 28 in which the piston for air 27 is contained so as to be freely slidable in the up-down direction; an air-liquid mixing chamber 29 that mixes liquid from the cylinder for liquid 26 with air from the cylinder for air 28; and a foaming member 30 that is disposed between the air-liquid mixing chamber 29 and the nozzle hole 14 and foams the air-liquid mixture from the air-liquid mixing chamber 29.

The cylinder for air 28 is formed in a cylindrical shape with a bottom. The cylinder for liquid 26 is formed in a cylindrical shape. The cylinder for air 28 and the cylinder for liquid 26 are disposed coaxially with the axis line O. An upper opening section of the cylinder for air 28 is sealed via packing that is provided between an inner surface of the attachment cap 11 and an upper surface of the mouth portion 1*a*. The cylinder for liquid 26 extends downwardly from a bottom portion of the cylinder for air 28. The cylinder for liquid 26 and the cylinder for air 28 are formed integrally. The cylinder for liquid 26 is formed so as to have a diameter smaller than that of the cylinder for air 28.

The piston for air 27 includes: an outer slide cylinder 31 that is fitted into the cylinder for air 28 so as to be freely slidable in the up-down direction in an airtight state; an inner slide cylinder 32 which is arranged on the inner side of the outer slide cylinder 31 and into which the stem 12 is inserted so as to be freely slidable in the up-down direction; a connector plate 33 that connects between an inner circumferential surface of the outer slide cylinder 31 and an outer circumferential surface of the inner slide cylinder 32; an air hole 34 that extends through the connector plate 33 in the up-down direction; and a valve body 35 that opens and closes the air hole 34.

Into the inner slide cylinder 32, the lower stem 20 is inserted. An upper end portion of the inner slide cylinder 32 is fitted into the lower end portion of the upper stem 21 so as to be freely slidable on the inner circumferential surface of the upper stem 21 in the up-down direction.

Between an upper edge of the inner slide cylinder 32 and an inner surface of the upper stem 21, a communication gap S is provided, which is a gap in the up-down direction. In the communication gap S, lower end portions of the longitudinal grooves 21*b* of the upper stem 21 are opened. The lower end portion of the upper stem 21 is opposed in a spaced manner to upper end portions of protruded rib portions 32*a* that are provided on the outer circumferential surface of the inner slide cylinder 32.

In a part of the outer circumferential surface of the lower stem 20 that is inserted into the inner slide cylinder 32, a plurality of stem grooves 20*a* are formed that extend in the up-down direction. In the outer circumferential surface of the inner slide cylinder 32, a plurality of protrusions are provided, and the stem groove 20*a* is formed between the protrusions. The stem grooves 20*a* are spaced from each other in the circumferential direction. Upper end portions of the stem grooves 20*a* are in communication with the communication gap S.

The air-liquid mixing chamber 29 is provided between the lower stem 20 and the upper stem 21. In the example shown in the figures, the air-liquid mixing chamber 29 is provided between the presser member 24 and the upper stem 21 (in the vicinity of the reduced-diameter part 21*a*). The air-liquid mixing chamber 29 is communicable with the inside of the cylinder for air 28 through an air passage 36 that is made of the longitudinal grooves 21*b*, the communication gap S, and the stem grooves 20*a*.

Here, in the present embodiment, around a part of the lower stem 20 that is located in the cylinder for air 28, an annular protrusion portion 37 is provided that protrudes outwardly in the radial direction. An upper surface portion of the protrusion portion 37 is in contact with a lower edge of the inner slide cylinder 32 of the piston for air 27. Therefore, opening sections of the air passage 36 in the cylinder for air 28 are closed, and hence, the communication between the inside of the cylinder for air 28 and the air-liquid mixing chamber 29 is blocked.

The piston for liquid 25 is formed in a multistage cylindrical shape whose diameter decreases gradually from the lower end to the upper end thereof. The piston for liquid 25 includes: an upper-side cylindrical portion 25*a* that is fitted into the stem 12 in a liquid-tight state; and a lower-side cylindrical portion 25*b* that protrudes downwardly from a lower-end opening edge of the stem 12 and is fitted into the cylinder for liquid 26 so as to be freely slidable in the up-down direction.

Between the upper-side cylindrical portion 25*a* and an inner surface of the lower end portion of the cylinder for liquid 26, a coil spring 38 is disposed that supports the piston for liquid 25 so as to be slidable in the downwardly in a state with the piston for liquid 25 being biased upwardly.

Inside the piston for liquid 25 and the cylinder for liquid 26, a rod-like valve member 39 is provided that extends in the up-down direction. An upper end portion of the valve member 39 functions as an upper valve body 39*a* that is seatable on/detachable from an upper opening section of the upper-side cylindrical portion 25*a* of the piston for liquid 25. A lower end portion of the valve member 39 functions as a lower valve body 39*b* that is seatable on/detachable from a lower opening section in the cylinder for liquid 26.

As shown in FIG. 2, the foaming member 30 is provided in the stem 12. In the example shown in the figure, the foaming member 30 is fitted into an upper end portion of the upper stem 21. The foaming member 30 is made of a plurality of (two, in the example shown in the figure) foaming elements 30*a* aligned in the up-down direction. The foaming element 30*a* is made of a cylinder in which a net body is provided over an opening end edge thereof. Of the two foaming elements 30*a*, the foaming element 30*a* on the upper side is provided with a net body only over an upper-end opening edge of the cylinder of two opening edges while the foaming element 30*a* on the lower side is provided with a net body only over a lower-end opening edge of the cylinder of two opening edges. Note that the number of the foaming elements 30*a* may be at least one. Furthermore, with the net body of the foaming element 30*a* (small mesh) located on the upper side and the net body of the foaming element 30*a* (large mesh) located on the lower side being altered in the mesh size, it is possible to produce finer foam.

Figure 3:
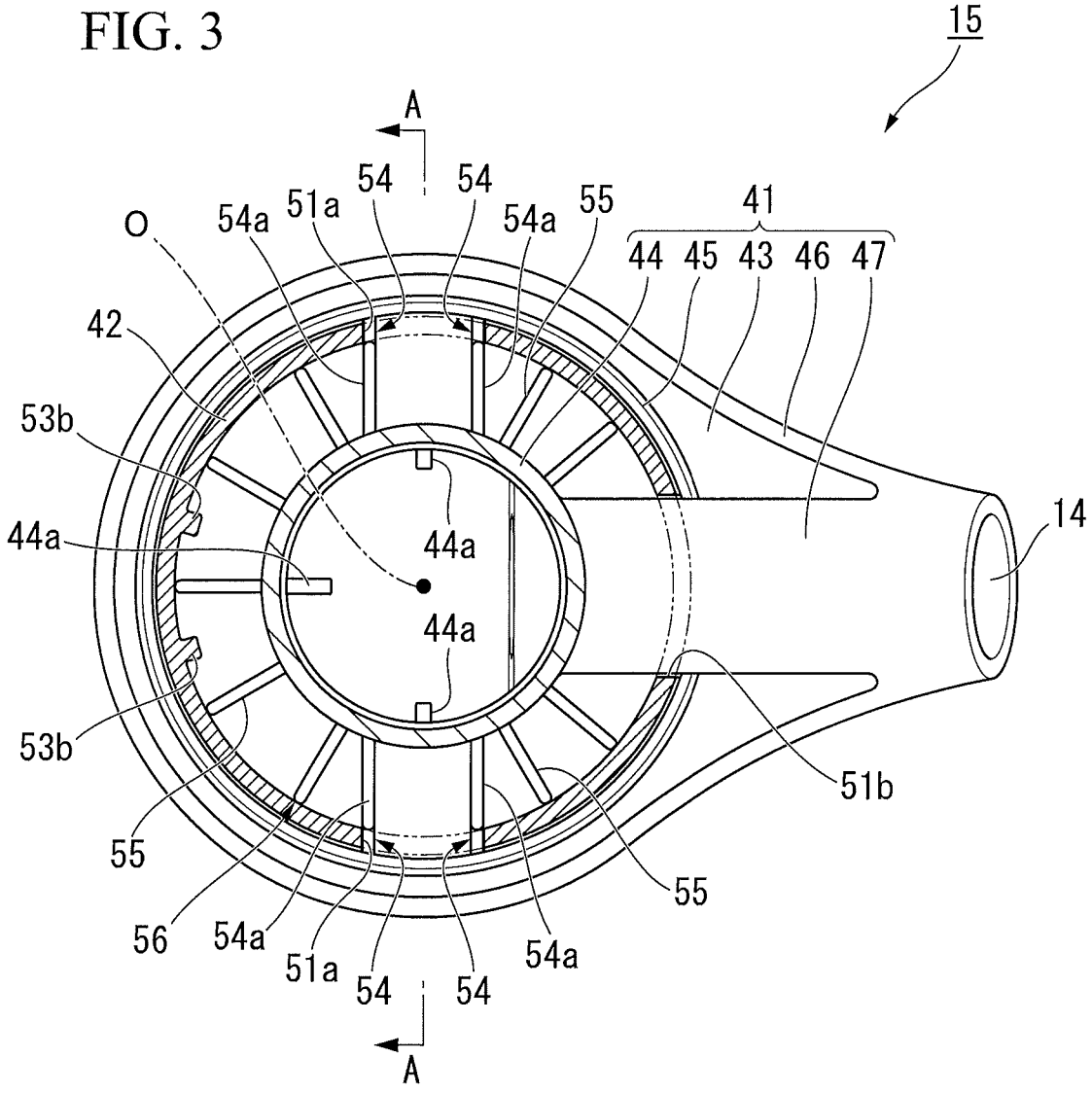
FIG. 3 is a partial lateral cross-sectional view of a depressing head constituting the foamer dispenser shown in FIG. 1.
Figure 4:
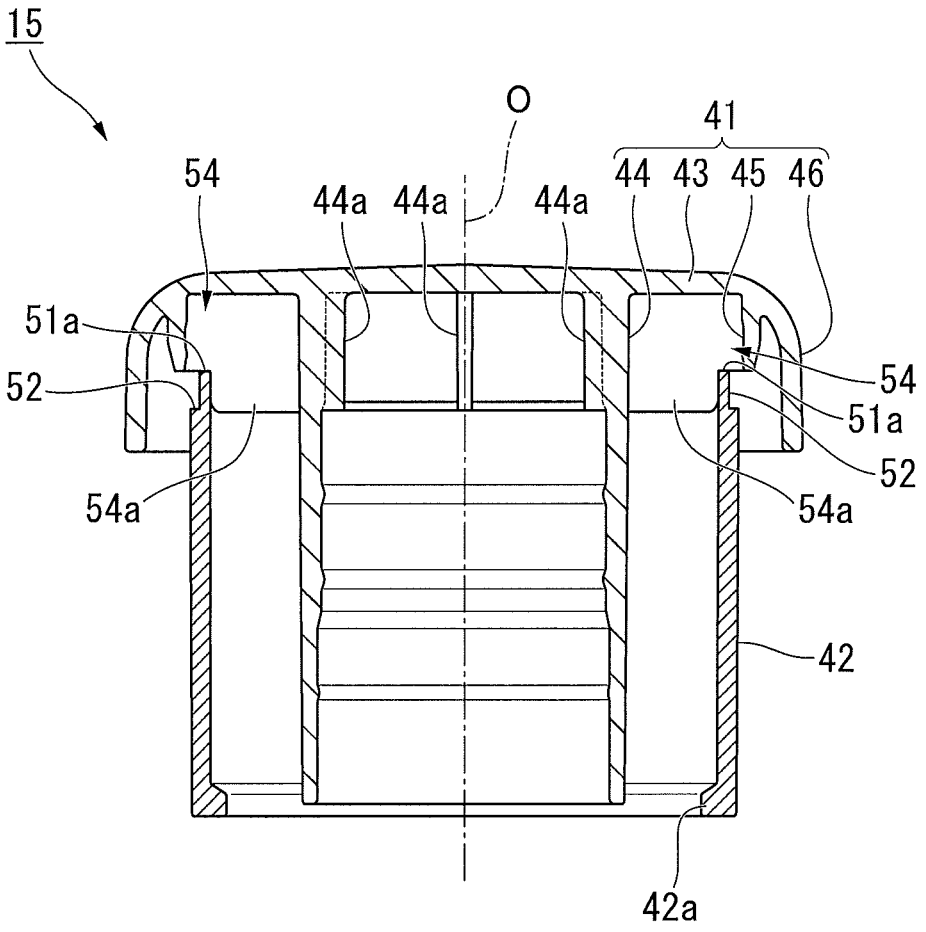
FIG. 4 is a cross-sectional view of FIG. 3, taken along and seen in the direction of the A-A arrow.

As shown in FIG. 2 to FIG. 4, the depressing head 15 includes: a head main unit 41; and an exterior cylindrical portion 42. The head main unit 41 and the exterior cylindrical portion 42 are formed as separate entities, and are fitted to each other. The head main unit 41 includes: a top wall portion 43; an attachment cylindrical portion 44; a fitting cylindrical portion 45; a covering wall portion 46; and a nozzle cylindrical portion 47. The top wall portion 43 is arranged above the stem 12.

The attachment cylindrical portion 44 extends downwardly from the top wall portion 43 and is attached to the stem 12. The attachment cylindrical portion 44 is arranged coaxially with the axis line O, and is fitted onto the upper end portion of the upper stem 21.

A lower end portion of the attachment cylindrical portion 44 is inserted into the guide cylindrical portion 17. The attachment cylindrical portion 44 is freely movable in the guide cylindrical portion 17 in the up-down direction.

On an inner circumferential surface of an upper end portion of the attachment cylindrical portion 44, restricting ribs 44*a* are provided that protrude inwardly in the radial direction. The restricting rib 44*a* is formed in a plate shape that extends in the up-down direction. Upper end portions of the restricting ribs 44*a* are connected to the top wall portion 43. Lower end portions of the restricting ribs 44*a* are in contact with the upper end portion of the upper stem 21.

The fitting cylindrical portion 45 protrudes downwardly from the top wall portion 43, and is arranged coaxially with the axis line O. The fitting cylindrical portion 45 surrounds the upper end portion of the attachment cylindrical portion 44 from the outer side in the radial direction.

The nozzle cylindrical portion 47 extends from the attachment cylindrical portion 44 outwardly in the radial direction, and protrudes further outwardly in the radial direction than the fitting cylindrical portion 45. The inside of the nozzle cylindrical portion 47 is in communication with the inside of the stem 12 through the inside of the upper end portion of the attachment cylindrical portion 44. In a protrusion end of the nozzle cylindrical portion 47, a nozzle hole 14 is provided. Hereinafter, in the radial direction, a direction in which the nozzle cylindrical portion 47 extends is referred to as forward-rearward direction. A direction in which the nozzle hole 14 opens along the forward-rearward direction is referred to as forward direction while a direction opposite thereto is referred to as rearward direction.

As shown in FIG. 3, the covering wall portion 46 extends downwardly from an outer circumferential edge of the top wall portion 43. The covering wall portion 46 is formed in a C shape that opens toward the forward direction in a planar view when the foamer dispenser 10 is seen in the up-down direction. A circumferential end portion of the covering wall portion 46 is connected to a side surface of the nozzle cylindrical portion 47 along the circumferential direction. The covering wall portion 46 covers the fitting cylindrical portion 45 and the upper end portion of the attachment cylindrical portion 44 from the outer side in the radial direction.

As shown in FIG. 2, the exterior cylindrical portion 42 is provided at a position below the top wall portion 43. An upper edge of the exterior cylindrical portion 42 is in contact with a lower surface of the top wall portion 43. An upper end portion of the exterior cylindrical portion 42 is fitted into the fitting cylindrical portion 45. On an upper end portion of the exterior cylindrical portion 42, an annular protruded strip portion 48 is provided that protrudes outwardly in the radial direction. The protruded strip portion 48 is fitted (undercut-fitted or the like) to an inner circumferential surface of the fitting cylindrical portion 45.

The exterior cylindrical portion 42 surrounds the attachment cylindrical portion 44 and the guide cylindrical portion 17 from the outer side in the radial direction. The inside of the exterior cylindrical portion 42 is communicable with the inside of the cylinder for air 28 through the inside of the guide cylindrical portion 17. A lower end portion of the exterior cylindrical portion 42 is arranged at a position equivalent in the up-down direction to that of the lower end portion of the attachment cylindrical portion 44. The lower end portion of the exterior cylindrical portion 42 surrounds the upper end portion of the guide cylindrical portion 17 from the outer side in the radial direction.

On the lower end portion of the exterior cylindrical portion 42, an outer guide protrusion 42*a* is provided that protrudes inwardly in the radial direction. The outer guide protrusion 42*a* is formed in an annular shape. In a state before the depressing head 15 is depressed, the outer guide protrusion 42*a* faces the inner guide protrusion 17*a* in the radial direction and is close to the inner guide protrusion 17*a*.

As shown in FIG. 2 to FIG. 7, in the upper end portion of the exterior cylindrical portion 42, intake holes 51*a*, 51*b* are formed. The intake holes 51*a*, 51*b* penetrate through the exterior cylindrical portion 42 in the radial direction, and open toward the upward direction. Hereinafter, the intake hole 51*a* is referred to also as first intake hole 51*a* while the intake hole 51*b* is referred to also as second intake hole 51*b*.

Figure 5:
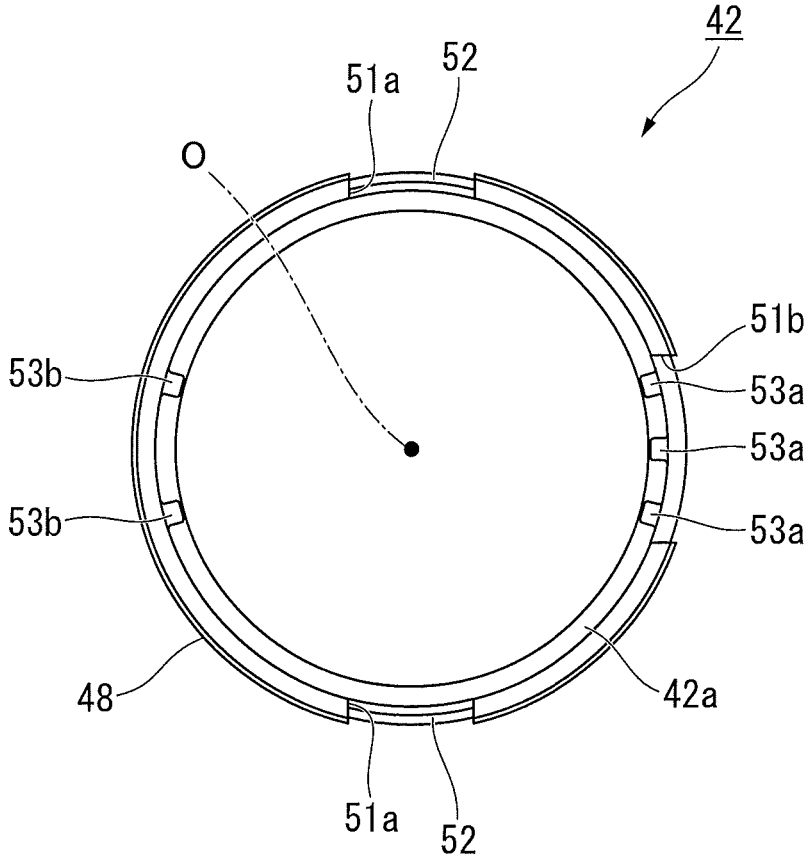
FIG. 5 is a planar view of an exterior cylindrical portion constituting the depressing head shown in FIG. 3.

As shown in FIG. 3 and FIG. 5, two first intake holes 51*a* are arranged in sections of the exterior cylindrical portion 42 that are located on both sides in the left-right direction, which is orthogonal to both of the up-down direction and the forward-rearward direction.

Figure 7:
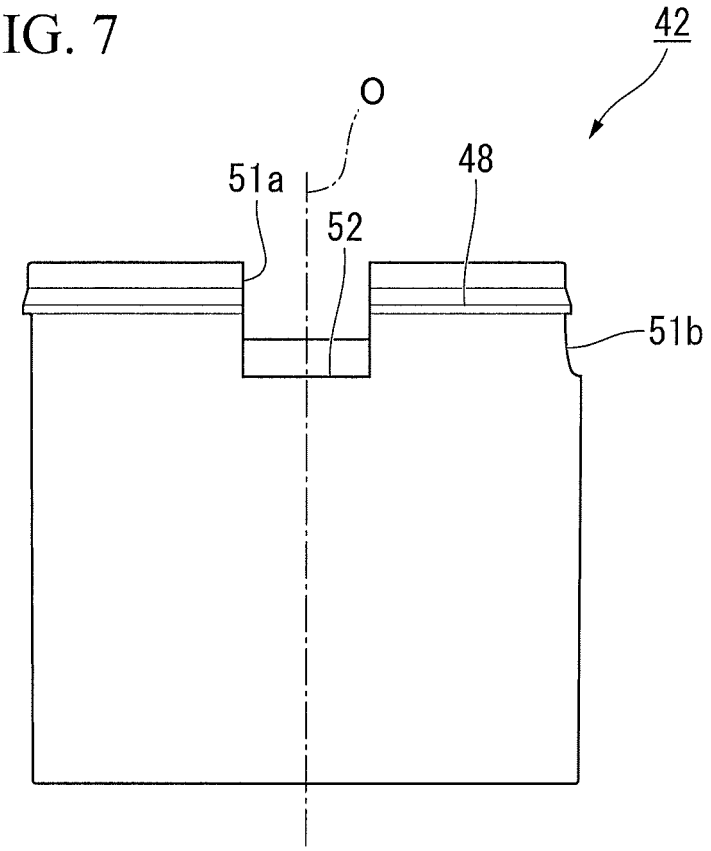
FIG. 7 is a side view of the exterior cylindrical portion shown in FIG. 5.

The two first intake holes 51*a* are formed so as to have equivalent shape and size. As shown in FIG. 7, the first intake hole 51*a* is formed so as to have a rectangular shape in a side view when the foamer dispenser 10 is seen in the left-right direction.

Here, in opening circumferential edges of the intake holes 51*a*, 51*b* in the outer circumferential surface of the exterior cylindrical portion 42, receding sections 52 are formed that recede inwardly in the radial direction and are continuous to the intake holes 51*a*, 51*b*. The receding section 52 is arranged in a part, of the opening circumferential edge of the first intake hole 51*a* in the outer circumferential surface of the exterior cylindrical portion 42, that continues to the first intake hole 51*a* from below. The receding section 52 is formed in a rectangular shape when seen in a side view. The size of the receding section 52 in the circumferential direction is equivalent to that of the first intake hole 51*a* in the circumferential direction.

As shown in FIG. 4, the first intake holes 51*a* are covered with the fitting cylindrical portion 45 and the covering wall portion 46 from the outer side in the radial direction. The first intake hole 51*a* is in communication with the outside of the foamer dispenser 10 through the receding section 52.

As shown in FIG. 2, FIG. 3, and FIG. 5, the second intake hole 51*b* is located on the forward side in the exterior cylindrical portion 42. The second intake hole 51*b* is arranged so that the position of the second intake hole 51*b* in the circumferential direction coincides with that of the nozzle cylindrical portion 47.

Into the second intake hole 51*b*, the nozzle cylindrical portion 47 is inserted from above. The nozzle cylindrical portion 47 extends forwardly from the second intake hole 51*b*, and protrudes further outwardly in the radial direction than the exterior cylindrical portion 42. A size of the second intake hole 51*b* in the circumferential direction is equivalent to that of the nozzle cylindrical portion 47 in the circumferential direction. A side surface of the nozzle cylindrical portion 47 is locked between parts of an inner circumferential edge of the second intake hole 51*b* that face inwardly in the circumferential direction.

The second intake hole 51*b* is larger than the nozzle cylindrical portion 47 in the up-down direction. Therefore, between a lower surface of the nozzle cylindrical portion 47 and a part of the inner circumferential edge of the second intake hole 51*b* that faces upwardly, a gap in the up-down direction is provided.

On an inner circumferential surface of the exterior cylindrical portion 42, guide ribs 53*a*, 53*b* are protrudingly provided that extend in the up-down direction. When the depressing head 15 is depressed obliquely, the guide ribs 53*a*, 53*b* are capable of slidably contacting the guide cylindrical portion 17 (the inner guide protrusion 17*a* of the guide cylindrical portion 17, in the example shown in the figures) from the outer side in the radial direction. The guide ribs 53*a* and the guide ribs 53*b* are arranged in sections of the exterior cylindrical portion 42 that are opposite to each other in the radial direction across the guide cylindrical portion 17. Hereinafter, the guide rib 53*a* is referred to also as first guide rib 53*a* while the guide rib 53*b* is referred to also as second guide rib 53*b*.

The first guide ribs 53*a* are arranged in a forward section of the exterior cylindrical portion 42. To be more specific, the first guide ribs 53*a* are arranged in a section beneath the second intake hole 51*b*. Upper end portions of the first guide ribs 53*a* are located on the side lower than the inner circumferential edge of the second intake hole 51*b*. Lower end portions of the first guide ribs 53*a* are connected to the outer guide protrusion 42*a*. The first guide ribs 53*a* extend straightly in the up-down direction, and are connected smoothly to a surface of the outer guide protrusion 42*a*.

As shown in FIG. 5, three first guide ribs 53*a* are spaced in the circumferential direction in the forward section of the exterior cylindrical portion 42. The three first guide ribs 53*a* are arranged at regular intervals in the circumferential direction. Of the three first guide ribs 53*a*, the one located in the middle in the circumferential direction is arranged right in the forward direction with respect to the axis line O.

Figure 6:
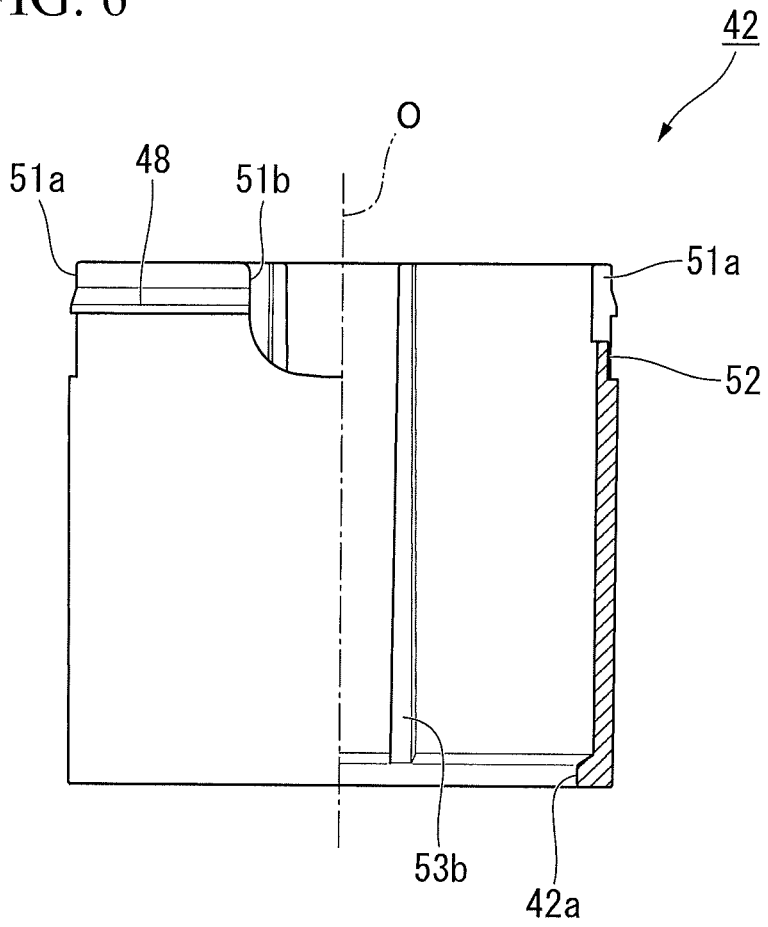
FIG. 6 is a view of a front side of the exterior cylindrical portion shown in FIG. 5. It is a half cross-sectional view of FIG. 5 in which a half side in the left-right direction is shown in a longitudinal cross-sectional view.

The second guide ribs 53*b* are arranged in a rear section, which is a section located on a side opposite to the first guide ribs 53*a* in the radial direction. As shown in FIG. 6, the second guide rib 53*b* is formed over the whole length of the rear section of the exterior cylindrical portion 42 in the up-down direction. Lower end portions of the second guide ribs 53*b* are connected to the outer guide protrusion 42*a*. The second guide ribs 53*b* extend straightly in the up-down direction, and are connected smoothly to a surface of the outer guide protrusion 42*a*.

As shown in FIG. 5, two second guide ribs 53*b* are spaced in the circumferential direction in the rear section of the exterior cylindrical portion 42. The two second guide ribs 53*b* are arranged to avoid a part of the exterior cylindrical portion 42 that is located right in the rear direction with respect to the axis line O.

As shown in FIG. 3 and FIG. 4, on the top wall portion 43 of the head main unit 41, pairs of lock portions 54 are provided that protrude downwardly and are spaced from each other in the circumferential direction. The pairs of lock portions 54 are each locked between parts of an inner circumferential edge of each of the intake holes 51*a*, 51*b* that face inwardly in the circumferential direction.

The pairs of lock portions 54 are each provided in each of the two first intake holes 51*a*, and are arranged in parts of the top wall portion 43 that are located on both sides in the left-right direction. The lock portion 54 is formed in a plate shape that extends in the radial direction. The lock portion 54 extends straightly along the left-right direction when seen in a planar view. Surfaces of the paired lock portions 54 that face in the circumferential direction are locked in the inner circumferential edge of the first intake hole 51*a*, and are close to or in contact with the inner circumferential edge of the first intake hole 51*a*.

The lock portion 54 connects between the attachment cylindrical portion 44 and the fitting cylindrical portion 45. To be more specific, an end section of the lock portion 54 on the inner side in the radial direction is connected to the attachment cylindrical portion 44 while an end section thereof on the outer side in the radial direction is connected to the fitting cylindrical portion 45.

As shown in FIG. 4, a size of the lock portion 54 in the up-down direction is smaller in a stepwise manner from the inner side to the outer side in the radial direction. Of the lock portion 54, an in-cylinder portion 54*a*, which is located inner in the radial direction than the exterior cylindrical portion 42 in the radial direction, protrudes further downwardly than a part that is located outer in the radial direction than the in-cylinder portion 54*a* and that is arranged in the first intake hole 51*a*. The in-cylinder portion 54*a* supports the exterior cylindrical portion 42 from the inner side in the radial direction. The in-cylinder portion 54*a* is close to or in contact with the inner circumferential surface of the exterior cylindrical portion 42 from the inner side in the radial direction.

As shown in FIG. 2 and FIG. 3, the top wall portion 43 is provided with a plurality of support plate portions 55 that protrude downwardly and extend in the radial direction. The support plate portions 55 are arranged in the circumferential direction. The support plate portions 55 are provided radially about the axis line O when seen in a planar view, and are arranged at intervals over the whole length in the circumferential direction. The support plate portions 55 are arranged at positions that avoid, in the circumferential direction, the nozzle cylindrical portion 47 and a section between each pair of lock portions 54.

As shown in FIG. 2, end sections of the support plate portions 55 on the inner side in the radial direction are connected to the attachment cylindrical portion 44. End sections of the support plate portions 55 on the outer side in the radial direction support the exterior cylindrical portion 42 from the inner side in the radial direction, and are close to or in contact with the inner circumferential surface of the exterior cylindrical portion 42 from the inner side in the radial direction. As shown in FIG. 3, the support plate portions 55 are spaced in the circumferential direction, to thereby constitute a plate portion train 56. The exterior cylindrical portion 42 is fitted onto the plate portion train 56.

In the foamer dispenser 10 as shown in FIG. 1 and FIG. 2, when the content substance is discharged, the restricting member 19 is removed and the depressing head 15 is depressed. Then, the guide cylindrical portion 17 moves into a gap between the attachment cylindrical portion 44 and the exterior cylindrical portion 42.

In the present embodiment, the nozzle cylindrical portion 47 protrudes from the attachment cylindrical portion 44 toward the forward direction. Therefore, in depressing the depressing head 15 with, for example, the nozzle cylindrical portion 47 being held, the depressing head 15 may be depressed in an obliquely forward or rearward direction, not in a straightly downward direction. This makes the positional relationship between the exterior cylindrical portion 42 and the head main unit 41 in the forward-rearward direction likely to be unstable. However, the first guide ribs 53*a* and the second guide ribs 53*b* are arranged in the sections of the exterior cylindrical portion 42 that are located on both sides in the forward-rearward direction. Therefore, when the depressing head 15 is depressed, the guide ribs 53*a*, 53*b* stabilize the position of the exterior cylindrical portion 42 in the forward-rearward direction.

Here, when the depressing head 15 is depressed as described above, the guide cylindrical portion 17 moves into the gap between the attachment cylindrical portion 44 and the exterior cylindrical portion 42. Then, the stem 12 and the piston for liquid 25 moves downwardly while compressing and deforming the coil spring 38 in the up-down direction.

At this time, a gap is formed between the lower end of the inner slide cylinder 32 and a top surface of the protrusion portion 37 of the stem 12. As a result, the inside of the cylinder for air 28 and the inside of the air-liquid mixing chamber 29 are in communication with each other through the air passage 36.

Furthermore, at this time, with the downward movement of the piston for liquid 25, the upper end portion of the piston for liquid 25 is detached from the upper valve body 39*a* of the valve member 39 in the downward direction. This causes the inside of the cylinder for liquid 26 and the inside of the stem 12 to be in communication with each other. Furthermore, the lower valve body 39*b* of the valve member 39 is also moved downwardly. As a result, the lower valve body 39*b* is seated on the lower opening section in the cylinder for liquid 26, and closes it.

When the depressing head 15 is further depressed, the piston for air 27 is also moved downwardly in a state with the air hole 34 being closed by the valve body 35. This compresses the air in a lower chamber in the cylinder for air 28 that is located beneath the piston for air 27. As a result, the air in the lower chamber flows through the gap between the lower end of the inner slide cylinder 32 in the piston for air 27 and the protrusion portion 37 of the stem 12 into the air passage 36, and is then transferred to the air-liquid mixing chamber 29.

Furthermore, at this time, in a state with the lower opening section of the cylinder for liquid 26 being closed by the lower valve body 39*b* of the valve member 39, the piston for liquid 25 moves downwardly. Therefore, the liquid in the cylinder for liquid 26 rises and reaches the inside of the stem 12. Then, a liquid pressure in the cylinder for liquid 26 acts on the liquid discharge valve 23 in the stem 12 to cause the liquid discharge valve 23 to be detached from the valve seat 22 upwardly. Thereby, the liquid in the cylinder for liquid 26 flows into the air-liquid mixing chamber 29.

After the liquid and the air, which have been joined together in the air-liquid mixing chamber 29 as described above, are caused to pass through the foaming member 30 to produce foam, the foamed body is caused to pass through the inside of the upper end portion of the attachment cylindrical portion 44 and the inside of the nozzle cylindrical portion 47. Then, the foam is caused to be discharged from the nozzle hole 14.

After that, when the depressing of the depressing head 15 is released, the piston for liquid 25 is pressed upwardly by the elastic restoring force of the coil spring 38. As a result, the upper opening section of the upper-side cylindrical portion 25*a* of the piston for liquid 25 is brought into contact with the upper valve body 39*a*. This blocks the communication between the inside of the cylinder for liquid 26 and the inside of the stem 12. Furthermore, the lower valve body 39*b* is detached from the lower opening section in the cylinder for liquid 26. This causes the inside of the container main unit 1 and the inside of the cylinder for liquid 26 to be in communication with each other. As a result, the content substance in the container main unit 1 flows into the cylinder for liquid 26. At this time, the inside of the container main unit 1 comes to have a negative pressure. Therefore, through an introduction hole provided in a part of the cylinder for air 28 that is located upper than the outer slide cylinder 31, the air in an upper chamber of the cylinder for air 28 that is located above the piston for air 27 is introduced into the container main unit 1.

Furthermore, with the piston for liquid 25 rising as described above, the stem 12 and the depressing head 15 rise in a unified manner. With the protrusion portion 37 of the stem 12 being brought into contact with the lower edge of the inner slide cylinder 32 of the piston for air 27, the communication between the lower chamber and the air-liquid mixing chamber 29 through the air passage 36 is blocked. In this condition, the stem 12 and the piston for air 27 rise in a unified manner to decrease the pressure in the lower chamber. This opens the valve body 35 to open the air hole 34. As a result, outside air is sucked into the lower chamber through the inside of the intake holes 51*a*, 51*b*, the inside of the exterior cylindrical portion 42, and the inside of the guide cylindrical portion 17.

Here, for example in a foamer dispenser in which the exterior cylindrical portion 42 is not provided with the intake holes 51*a*, 51*b*, when the depressing head 15 moves back upwardly, outside air is sucked into the exterior cylindrical portion 42 through a gap between the inner circumferential surface of the exterior cylindrical portion 42 and the outer circumferential surface of the guide cylindrical portion 17 (hereinafter, referred to as "cylinder-cylinder gap"), and is then drawn into the cylinder for air 28 through the inside of the guide cylindrical portion 17. If foreign matter such as water is attached to an external surface of the attachment cap 11, there is a possibility that, when the depressing head 15 moves back upwardly, the foreign matter together with the air is drawn into the exterior cylindrical portion 42 through the cylinder-cylinder gap and further into the cylinder for air 28.

On the other hand, in the foamer dispenser 10 of the present embodiment, the intake holes 51*a*, 51*b* are formed in the upper end portion of the exterior cylindrical portion 42. Therefore, when the depressing of the depressing head 15 is released to cause the inside the cylinder for air 28 to have a negative pressure, it is possible to suck the outside air into the exterior cylindrical portion 42 through the intake holes 51*a*, 51*b* as described above. As a result, sucking of the outside air into the exterior cylindrical portion 42 through the cylinder-cylinder gap is inhibited, and hence, sucking of foreign matter together with the outside air into the exterior cylindrical portion 42 through the cylinder-cylinder gap is inhibited.

As described above, according to the foamer dispenser 10 of the present embodiment, the intake holes 51*a*, 51*b* are formed in the upper end portion of the exterior cylindrical portion 42. Therefore, as described above, it is possible to inhibit the sucking of the outside air together with foreign matter into the exterior cylindrical portion 42 through the cylinder-cylinder gap, and hence, it is possible to inhibit the intrusion of foreign matter into the cylinder for air 28.

Furthermore, the intake holes 51*a*, 51*b* are formed in the upper end portion of the exterior cylindrical portion 42. Therefore, it is possible to maintain a low influence that the intake holes 51*a*, 51*b* have on the appearance of the depressing head 15.

Furthermore, the intake holes 51*a*, 51*b* open toward the upward direction. Therefore, for example, when the exterior cylindrical portion 42 is molded with a mold, it is possible to remove the mold with ease, and hence, to make it easy to form the foamer dispenser 10 in a simplified manner.

Furthermore, the receding sections 52 are formed in the opening circumferential edges of the intake holes 51*a*, 51*b* in the outer circumferential surface of the exterior cylindrical portion 42. This makes it difficult for foreign matter such as water to intrude. Furthermore, it is possible to introduce outside air into the intake holes 51*a*, 51*b* through the receding sections 52, and hence, to effectively suck the outside air into the exterior cylindrical portion 42 through the intake holes 51*a*, 51*b*.

Furthermore, the head main unit 41 includes the covering wall portion 46. Therefore, it is possible to inhibit the intake holes 51*a*, 51*b* from being exposed to the outside, and hence, to maintain the appearance of the foamer dispenser 10 favorable.

Furthermore, the top wall portion 43 is provided with the pairs of lock portions 54. Therefore, when the head main unit 41 and the exterior cylindrical portion 42 are to rotate relatively to each other in the circumferential direction, the lock portions 54 are locked in the inner circumferential edges of the intake holes 51*a*, 51*b*, to thereby make it possible to restrict the rotation. Furthermore, when the exterior cylindrical portion 42 is to be deformed so that the intake holes 51*a*, 51*b* are narrowed in the circumferential direction, the lock portions 54 are locked in the inner circumferential edges of the intake holes 51*a*, 51*b*. Thereby, it is possible to restrict the deformation.

Furthermore, the pairs of lock portions 54 are spaced in the circumferential direction. Therefore, while the rotation and deformation as described above is being restricted, it is possible to securely bring the inside and outside of the exterior cylindrical portion 42 into communication with each other through the parts of the intake holes 51*a*, 51*b* that are located between the paired lock portions 54. Consequently, it is possible to securely suck the outside air into the exterior cylindrical portion 42 through the intake holes 51*a*, 51*b*.

In the present embodiment, the top wall portion 43 is provided with the fitting cylindrical portion 45 that protrudes downwardly and that is fitted onto the attachment cylindrical portion 44, and the lock portions 54 connect between the attachment cylindrical portion 44 and the fitting cylindrical portion 45. In this case, when the lock portions 54 are locked in the inner circumferential edges of the intake holes 51*a*, 51*b*, it is possible to support both ends of the lock portions 54 in the radial direction by means of the attachment cylindrical portion 44 and the fitting cylindrical portion 45. Therefore, it is possible to effectively restrict the aforementioned rotation and deformation.

Furthermore, the plurality of support plate portions 55 are arranged in the top wall portion 43, and moreover, the ends of the support plate portions 55 on the inner side in the radial direction are connected to the attachment cylindrical portion 44 while the ends of the support plate portions 55 on the outer side in the radial direction support the exterior cylindrical portion 42 from the inner side in the radial direction. Therefore, for example, when the exterior cylindrical portion 42 is about to shake in the radial direction with respects to the head main unit 41, it is possible to cause the top wall portion 43 and the attachment cylindrical portion 44 to support the exterior cylindrical portion 42 via the support plate portions 55. Therefore, it is possible to attach the exterior cylindrical portion 42 tightly to the head main unit 41. Consequently, for example, it is possible to inhibit shaking between the exterior cylindrical portion 42 and the head main unit 41.

Furthermore, the top wall portion 43 is provided with the fitting cylindrical portion 45. This makes it possible to sandwich the exterior cylindrical portion 42 between the support plate portions 55 and the fitting cylindrical portion 45 in the radial direction. Therefore, it is possible to attach the exterior cylindrical portion 42 further tightly to the head main unit 41.

Furthermore, the in-cylinder portions 54*a* of the lock portions 54 support the exterior cylindrical portion 42 from the inner side in the radial direction. This makes it possible to support the exterior cylindrical portion 42 from the inner side in the radial direction not only by the support plate portions 55 but also by the in-cylinder portions 54*a* of the lock portions 54. Therefore, it is possible to attach the exterior cylindrical portion 42 further tightly to the head main unit 41.

Furthermore, the guide ribs 53*a*, 53*b* are protrudingly provided on the inner circumferential surface of the exterior cylindrical portion 42. Therefore, for example, when the depressing head 15 is obliquely depressed, the guide cylindrical portion 17 is made slidable on the guide ribs 53*a*, 53*b* in the up-down direction, and hence, it is possible to restrict the displacement of the exterior cylindrical portion 42 in the radial direction by means of the guide cylindrical portion 17. As a result, it is possible to stabilize the position of the exterior cylindrical portion 42 in the radial direction. Consequently, it is possible to stabilize the positional relationship between the exterior cylindrical portion 42 and the head main unit 41 in the radial direction.

Furthermore, the guide ribs 53*a*, 53*b* are arranged in the sections of the exterior cylindrical portion 42 that are opposite to each other in the radial direction across the guide cylindrical portion 17. Therefore, when the depressing head 15 is obliquely depressed, the guide ribs 53*a*, 53*b* are made capable of slidably contacting the guide cylindrical portion 17 from both outer sides in the radial direction. Consequently, it is possible to further stabilize the position of the exterior cylindrical portion 42 in the radial direction.

Furthermore, the first guide ribs 53*a* and the second guide ribs 53*b* are arranged in the sections of the exterior cylindrical portion 42 that are located on both sides in the forward-rearward direction. Therefore, when the depressing head 15 is obliquely depressed, it is possible to stabilize the position of the exterior cylindrical portion 42 in the forward-rearward direction by means of the first guide ribs 53*a* and the second guide ribs 53*b*. Therefore, it is possible to securely stabilize the positional relationship between the exterior cylindrical portion 42 and the head main unit 41 in the forward-rearward direction.

The technical scope of the present invention is not limited to the aforementioned embodiment. Various modifications can be made without departing from the spirit or scope of the present invention.

For example, in a modification of the present invention, the restricting member 19 may not be provided.

In the aforementioned embodiment, the first guide ribs 53*a* and the second guide ribs 53*b* are provided. However, the present invention is not limited to this. For example, guide ribs may be arranged in sections of the exterior cylindrical portion that are located on both sides in the left-right direction.

In a modification of the present invention, the guide ribs 53*a*, 53*b* may not be arranged in the sections of the exterior cylindrical portion 42 that are opposite to each other in the radial direction across the guide cylindrical portion 17. Furthermore, the guide ribs 53*a*, 53*b* may not be provided.

In a modification of the present invention, the in-cylinder portions 54*a* of the lock portions 54 may not support the exterior cylindrical portion 42 from the inner side in the radial direction. Furthermore, the lock portions 54 may not connect between the attachment cylindrical portion 44 and the fitting cylindrical portion 45. Furthermore, the lock portion 54 may not be provided.

In a modification of the present invention, the nozzle cylindrical portion 47, the fitting cylindrical portion 45, and the covering wall portion 46 may not be provided. In this case, for example, the nozzle hole may be made of a through-hole that penetrates through the exterior cylindrical portion. Furthermore, the support plate portion 55 may not be provided.

In a modification of the present invention, the receding sections 52 may not be provided.

In the aforementioned embodiment, the first intake holes 51*a* and the second intake hole 51*b* are provided. However, the present invention is not limited to this. For example, as intake hole(s), at least either the first intake holes or the second intake hole may be provided.

(Second Embodiment)

Figure 8:
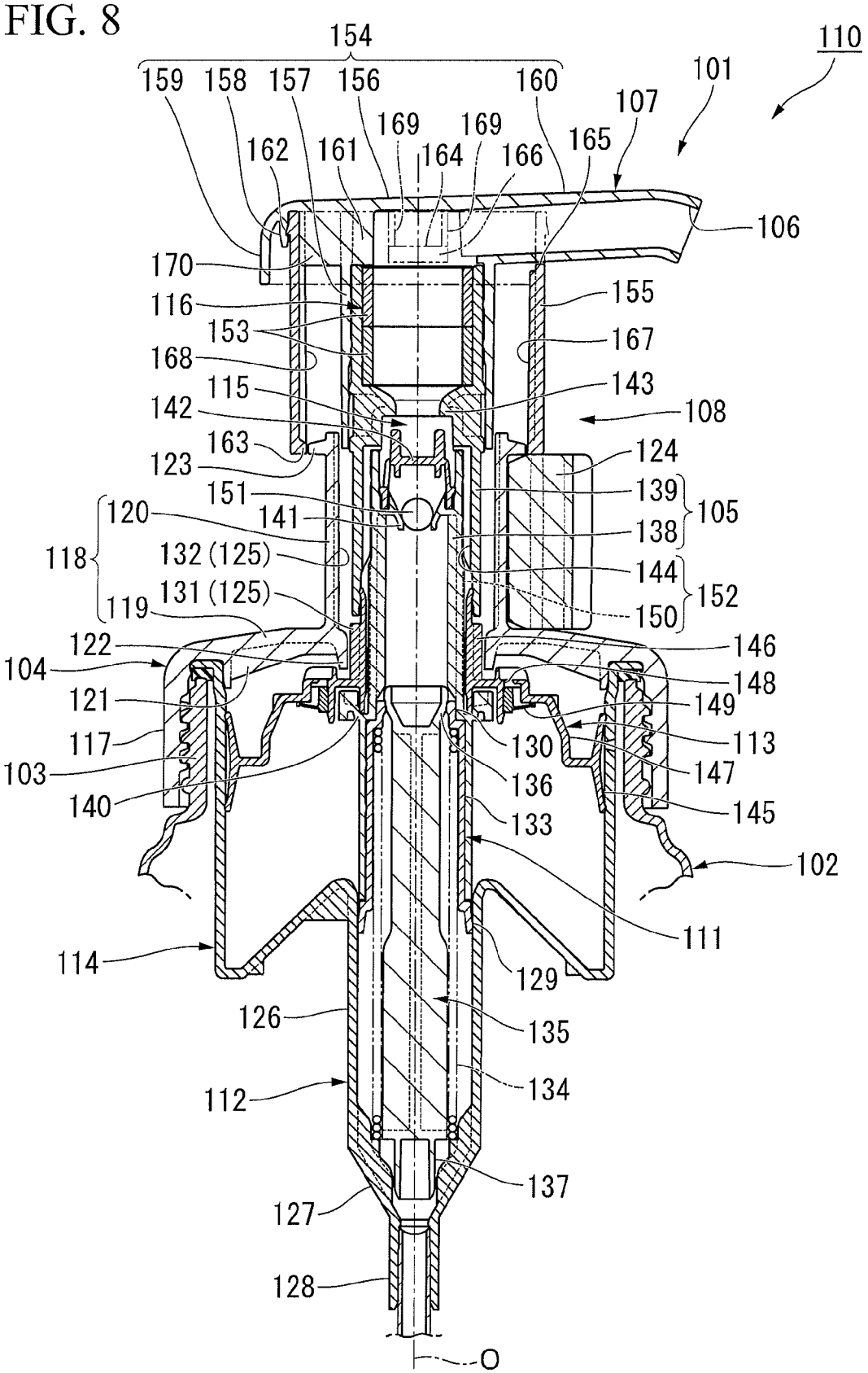
FIG. 8 is a longitudinal cross-sectional view of a discharge container including a foamer dispenser according to a second embodiment of the present invention.

Hereunder is a description of a discharge vessel 110 including a foamer dispenser 101 according to a second embodiment of the present invention, with reference to FIG. 8.

As shown in FIG. 8, the discharge vessel 110 includes: a foamer dispenser 101 and a container main unit 102. In the container main unit 102, a liquid-like content substance (content liquid) is contained. The foamer dispenser 101 transforms the content substance in the container main unit 102 into a bubble form and discharges it to the outside of the container. As the content substance, for example a skin wash fluid (body-wash) may be listed. For an exemplary content substance, the component table as shown in Table 1 described above is used.

In FIG. 8, the foamer dispenser 101 includes: an attachment cap 104 attached to a mouth portion 103 of a container main unit 102 in which a content substance is contained; and a discharge device 108 with a stem 105 and with a depressing head 107. The stem 105 is erected through the attachment cap 104 so as to be movable downwardly while being biased upwardly. The depressing head 107is attached to the stem 105 and a discharge hole 106 is formed in the depressing head 107. The discharge device 108 includes: a piston for liquid 111; a cylinder for liquid 112; a piston for air 113; a cylinder for air 114; an air-liquid mixing chamber 115; and a foaming member 116. The piston for liquid 111 moves in the up-down direction in conjunction with the stem 105. Inside the cylinder for liquid 112, the piston for liquid 111 is disposed so as to be slidable in the up-down direction. The piston for air 113 moves in the up-down direction in conjunction with the stem 105. Inside the cylinder for air 114, the piston for air 113 is disposed so as to be slidable in the up-down direction. The air-liquid mixing chamber 115 mixes the content substance transferred from the cylinder for liquid 112 with the air transferred from the cylinder for air 114. The foaming member 116 is disposed between the air-liquid mixing chamber 115 and the discharge hole 106, and foams the air-liquid mixture that has been mixed in the air-liquid mixing chamber 115. The piston for liquid 111, the cylinder for liquid 112, the piston for air 113, the cylinder for air 114, the air-liquid mixing chamber 115, and the foaming member 116 constitute a discharge mechanism of the discharge device 108.

In the foamer dispenser 101, the depressing head 107 is depressed with respect to the container main unit 102 to move the stem 105 downwardly, to thereby activate the discharge mechanism. As a result, the content substance in the container main unit 102 is transferred upwardly and is mixed with air. The bubble-like content substance, which is a foamed air-liquid mixture obtained in this manner, is discharged from the discharge hole 106 of the depressing head 107 toward a side of the container.

In FIG. 8, the mouth portion 103 of the container main unit 102, the attachment cap 104, the stem 105, and the depressing head 107 have their central axis lines arranged on a common axis. Hereinafter, the common axis is referred to as axis line O, a direction on the side of the depressing head 107 along the axis line O direction (upper side in FIG. 8) is referred to as upper direction while a direction on the side of a bottom portion of the container main unit 102 (lower side in FIG. 8) is referred to as lower direction. Furthermore, a direction that is orthogonal to the axis line O is referred to as radial direction while a direction about the axis line O is referred to as circumferential direction.

The attachment cap 104 includes: a circumferential wall portion (attachment circumferential wall portion) 117 that is attached to the mouth portion 103 of the container main unit 102; and a guide portion 118 which continues to an inner side of the circumferential wall portion 117 in the radial direction and through which the discharge device 108 is inserted in the up-down direction.

In the example shown in the figure, the circumferential wall portion 117 is detachably attached to the mouth portion 103 by screwing. The circumferential wall portion 117 may be attached to the mouth portion 103 by, for example, undercut-fitting or the like instead of screwing. Furthermore, the guide portion 118 includes: an annular ceiling wall portion 119 which is arranged above the mouth portion 103 and through which the stem 105 is inserted; and a guide cylindrical portion 120 that is erected on an inner circumferential edge of the ceiling wall portion 119. To be more specific, the guide cylindrical portion 120 has a smaller diameter than that of the circumferential wall portion 117, and besides, an upper end portion of the circumferential wall portion 117 and a lower end portion of the guide cylindrical portion 120 are connected to each other via an annular-plate-like ceiling wall portion 119.

On the ceiling wall portion 119, a plurality of ribs 121 that protrude downwardly and extend in the radial direction are spaced in the circumferential direction. Furthermore, on the inner circumferential edge of the ceiling wall portion 119, an insertion cylinder 122 is provided so as to extend downwardly from the inner circumferential edge of the ceiling wall portion 119, and inner ends of the ribs 121 in the radial direction are connected to an outer circumferential surface of the insertion cylinder 122. In the example shown in the figure, the insertion cylinder 122 of the ceiling wall portion 119 has an inner diameter smaller than that of the guide cylindrical portion 120.

On the upper end portion of the guide cylindrical portion 120, an annular inner guide protrusion 123 is formed that protrudes outwardly along the circumferential direction and extends along the circumferential direction. To a part of the guide cylindrical portion 120 that is located beneath the inner guide protrusion 123, a restricting member 124 is attached that restricts a downward movement of the depressing head 107 with respect to the guide cylindrical portion 120. The restricting member 124 has a C shape in a top view when the foamer dispenser 101 is seen from above, and is detachably fitted onto the guide cylindrical portion 120.

On the inner circumferential surface of the guide cylindrical portion 120, guide ribs 125 are provided that protrude inwardly in the radial direction and extend along the up-down direction. As the guide ribs 125, the foamer dispenser 101 of the present embodiment has third guide ribs 131 and fourth guide ribs 132, which will be described later. The guide ribs 125 provided on the guide cylindrical portion 120 are the fourth guide ribs 132.

In the foamer dispenser 101, either one of an outer circumferential surface of an insertion section of the discharge device 108 that is inserted through the guide portion 118 and an inner circumferential surface of the guide portion 118 is provided with the guide ribs 125 that are slidable with respect to the other in the up-down direction. The fourth guide ribs 132 are provided on either one of the guide cylindrical portion 120 and an attachment cylindrical portion 157 (described later) of the depressing head 107 so as to be slidable with respect to the other. In the present embodiment, the fourth guide ribs 132 are formed on the guide cylindrical portion 120 so as to be slidable in the up-down direction with respect to the attachment cylindrical portion 157.

The cylinder for air 114 is formed in a cylindrical shape with a circumferential wall and a bottom wall. On an upper opening section of the circumferential wall, a flange is formed that protrudes outwardly in the radial direction and extends along the circumferential direction. Sandwiched between packing provided on a top surface of the mouth portion 103 of the container main unit 102 and the ceiling wall portion 119 of the attachment cap 104 in the up-down direction, the cylinder for air 114 is fixed to the container main unit 102 and the attachment cap 104. The bottom wall of the cylinder for air 114 is further inclined toward the upper direction as it is closer to the inner side in the radial direction.

The cylinder for liquid 112 is formed integrally with the cylinder for air 114. The cylinder for liquid 112 includes: a base cylindrical portion 126 that extends downwardly from an inner circumferential edge of the bottom wall of the cylinder for air 114; a tapered cylindrical portion 127 that is connected to a lower end of the base cylindrical portion 126 so as to extend downwardly and has a diameter that gradually decreases as it extends further downwardly; and a pendant cylindrical portion 128 that is connected to a lower end of the tapered cylindrical portion 127 so as to extend downwardly. On an inner circumferential surface of a section of the cylinder for liquid 112 at which the base cylindrical portion 126 and the tapered cylindrical portion 127 are connected, a plurality of longitudinal ribs are protrudingly provided that extend in the up-down direction. The longitudinal ribs are spaced in the circumferential direction. Into the pendant cylindrical portion 128, a suction pipe is fitted that extends toward a bottom portion of the container main unit 102.

In the cylinder for liquid 112, the piston for liquid 111 is disposed so as to be freely slidably in the up-down direction. The piston for liquid 111 is linked to the stem 105. To be more specific, the piston for liquid 111 is linked to the stem 105 so as to move in the up-down direction together with the stem 105. The piston for liquid 111 is formed in a cylindrical shape. In a lower end portion of the piston for liquid 111, a large-diameter section 129 is provided that is fitted into the cylinder for liquid 112 so as to be slidable in the up-down direction in a liquid-tight state. In an upper end portion of the piston for liquid 111, a small-diameter section 130 is provided that is detachably fitted to an upper valve body 136 of a valve member 135. In a middle part of the piston for liquid 111 that is located between the lower end portion and the upper end portion, a middle-diameter section 133 is provided that connects between the large-diameter section 129 and the small-diameter section 130.

The piston for liquid 111 is biased upwardly by a biasing member 134 that is provided between the upper end portion of the piston for liquid 111 and the longitudinal ribs of the cylinder for liquid 112. As the biasing member 134, for example a coil spring or a resin spring may be adopted.

Through the cylinder for liquid 112, the piston for liquid 111, and the biasing member 134, the rod-like valve member 135 is inserted so as to be movable in the up-down direction. In an upper end portion of the valve member 135, the upper valve body 136 with an inverted hollow conical shape is formed. In a lower end portion of the valve member 135, a lower valve body 137 is formed. The upper valve body 136 is spaceably seated on a valve seat portion, which is formed in the upper end portion (small-diameter section 130) of the piston for liquid 111, from above the valve seat portion. The lower valve body 137 is upwardly spaced away from the tapered cylindrical portion 127 of the cylinder for liquid 112, and is seatable on the tapered cylindrical portion 127. On an outer circumferential surface of the lower valve body 137, guide protrusions are protrudingly provided, each of which is disposed between the adjacent longitudinal ribs of the cylinder for liquid 112.

The stem 105 is provided so as to be movable downwardly in the mouth portion 103 of the container main unit 102 while being biased upwardly. The stem 105 includes: a lower stem 138; and an upper stem 139. The lower stem 138 and the upper stem 139 are both formed in a cylindrical shape.

The lower stem 138 is inserted through the cylinder for air 114. The lower stem 138 is formed so that the lower portion thereof has a larger diameter than that of the upper portion thereof. The lower portion of the lower stem 138 is fitted onto the middle-diameter section 133 of the piston for liquid 111 while a lower end portion of the upper portion of the lower stem 138 is fitted onto the small-diameter section 130 of the piston for liquid 111. On a connection part of the lower stem 138 between the upper portion and the lower portion, an annular flange portion 140 is provided that protrudes outwardly in the radial direction and extends along the circumferential direction. Furthermore, on a part of the upper portion of the lower stem 138 that is upper than the connection part, an annular valve seat 141 is provided that protrudes inwardly in the radial direction and extends along the circumferential direction. On the valve seat 141, a liquid discharge valve 151 with a spherical shape is seated so as to be upwardly spaceable.

An upper end portion of the lower stem 138 is arranged in the guide cylindrical portion 120. In the upper end portion of the lower stem 138, a presser member 142 having a cylindrical shape with a top is provided. The presser member 142 is formed via support pillars. The presser member 142 is mounted on the valve seat 141, and is undercut-fitted between the lower stem 138 and the valve seat 141. Between the support pillars of the presser member 142, a circulation hole is opened that penetrates through the corresponding support pillar in the radial direction. On a ceiling wall of the presser member 142, an upper cylinder is provided toward the upper direction and a lower cylinder is provided toward the lower direction.

The upper stem 139 is inserted into the guide cylindrical portion 120 of the attachment cap 104, and is fitted onto the upper end portion of the lower stem 138. The lower end portion of the upper stem 139 has an inner diameter larger than that of an out-fitted part of the upper stem 139 that is located upper than the lower end portion and that is fitted onto the upper end portion of the lower stem 138. In a middle part of the upper stem 139 that is located between the lower end portion and the upper end portion, a reduced-diameter part 143 is formed that has an inner diameter smaller than those of other parts.

In a part of the inner circumferential surface of the upper stem 139 that is located lower than the reduced-diameter part 143, longitudinal grooves 144 are formed that extend in the up-down direction. Upper end portions of the longitudinal grooves 144 open inwardly in the radial direction to be in communication with the air-liquid mixing chamber 115 while lower end portions of the longitudinal grooves 144 open downwardly.

The piston for air 113 is disposed in the cylinder for air 114 so as to be freely slidable in the up-down direction.

The piston for air 113 is linked to the stem 105. To be more specific, the piston for air 113 is movable in the up-down direction correspondingly to the movement of the stem 105 in the up-down direction, and is also movable in the up-down direction with respect to the stem 105.

The piston for air 113 includes: an outer slide cylinder 145; an inner slide cylinder 146; a connector plate 147; an air hole 148; and a valve body 149. The outer slide cylinder 145 is fitted to the inside of the cylinder for air 114 so as to be freely slidable in the up-down direction in an airtight state. The inner slide cylinder 146 has a diameter smaller than that of the outer slide cylinder 145, and is arranged on an inner side of the outer slide cylinder 145 in the radial direction. Furthermore, the inner slide cylinder 146 is fitted onto an upper portion of the lower stem 138 of the stem 105 so as to be slidable in the up-down direction. The connector plate 147 connects between an inner circumferential surface of the outer slide cylinder 145 and an outer circumferential surface of the inner slide cylinder 146. The air hole 148 penetrates through the connector plate 147 in the up-down direction. The valve body 149 is in contact spaceably with a lower surface of the connector plate 147, to thereby openably close the air hole 148.

Through the inner slide cylinder 146, a part of the lower stem 138 that corresponds to the piston for air is inserted so as to be slidable in the up-down direction. The part is located upper than the flange portion 140 and lower than the valve seat 141. To be more specific, into the inner slide cylinder 146, a part of the lower stem 138 that corresponds to the piston for air is inserted; and between an inner circumferential surface of the inner slide cylinder 146 and an outer circumferential surface of the part that corresponds to the piston for air, a gap is provided. In the upper portion thereof, the gap is communicable with the inside of the longitudinal grooves 144. In the lower portion thereof, the gap is communicable with the inside of the cylinder for air 114 through the space between the flange portion 140 and the connector plate 147. In a state with the inner slide cylinder 146 of the piston for air 113 being seated on the flange portion 140, the communication between the inside of the cylinder for air 114 and the gap between the inner circumferential surface of the inner slide cylinder 146 and the outer circumferential surface of the part that corresponds to the piston for air is blocked.

In the outer circumferential surface of the part of the lower stem 138 that corresponds to the piston for air, a plurality of longitudinal grooves 150 are formed that are spaced in the circumferential direction and extend in the up-down direction. The longitudinal grooves 150 are arranged correspondingly to the spaces between the third guide ribs 131 (described later) of the inner slide cylinder 146 that are adjacent to each other in the circumferential direction.

Onto an upper end portion of the inner slide cylinder 146, a lower end portion of the upper stem 139 is fitted so as to be freely slidable in the up-down direction. On a part of the inner slide cylinder 146 that is located between the upper end portion and the lower end portion (to be more specific, a connection part of the inner slide cylinder 146 that is connected to the connector plate 147), the third guide ribs 131 (guide ribs 125) are provided that protrude outwardly in the radial direction and extend along the up-down direction. Furthermore, the inner slide cylinder 146 is inserted into the insertion cylinder 122 of the ceiling wall portion 119 of the attachment cap 104. A lower edge of the inner slide cylinder 146 is seated spaceably on the flange portion 140.

Here, the third guide ribs 131 are provided on either one of the inner slide cylinder 146 and the ceiling wall portion 119 so as to be slidable with respect to the other. In the present embodiment, the third guide ribs 131 are formed on the inner slide cylinder 146 so as to be slidable in the up-down direction with respect to the insertion cylinder 122 of the ceiling wall portion 119. Furthermore, above the third guide ribs 131, a lower-end opening edge of the upper stem 139 is arranged so as to face the third guide ribs 131 with a gap therebetween.

Over the whole circumference, the connector plate 147 connects between the lower end portion of the inner slide cylinder 146 and a central section of the outer slide cylinder 145 along the up-down direction. The connector plate 147 is formed in an annular plate-like cylindrical shape or a cylindrical shape with a top whose diameter increases stepwise toward the lower direction. The inside of the cylinder for air 114 is divided into an upper chamber and a lower chamber by the connector plate 147. Through the air hole 148 of the connector plate 147, the upper chamber and the lower chamber are communicable with each other.

The air-liquid mixing chamber 115 mixes the content substance from the cylinder for liquid 112 with the air from the cylinder for air 114. The air-liquid mixing chamber 115 is disposed in the stem 105. In the example shown in the figure, the air-liquid mixing chamber 115 is located between the presser member 142 disposed in the upper end portion of the lower stem 138 and the vicinity of the reduced-diameter part 143 of the upper stem 139. The air-liquid mixing chamber 115 is communicable with a lower chamber of the cylinder for air 114 through the insides of the longitudinal grooves 144, through a gap between the inner slide cylinder 146 and the part of the lower stem 138 that corresponds to the piston for air, and through air introduction passages 152 for which the insides of the longitudinal grooves 150 are used.

The foaming member 116 is provided in the stem 105. To be more specific, the foaming member 116 is fitted into an upper end portion of the upper stem 139, and is mounted on the reduced-diameter part 143. The foaming member 116 is made of a plurality of foaming elements 153 aligned in the up-down direction. The foaming element 153 is made of a cylindrical body in which a net body is stretched over an opening end edge of the cylindrical body. In the present embodiment, two foaming elements 153 are provided in the up-down direction. Of the two foaming elements 153, the foaming element 153 on the upper side is provided with a net body only over an upper-end opening edge of the cylindrical body while the foaming element 153 on the lower side is provided with a net body only over a lower-end opening edge of the cylindrical body.

Note that the numbers of the foaming elements 153 and the net bodies may be at least one, respectively. Furthermore, with the net body of the foaming element 153 (fine mesh) located on the upper side and the net body of the foaming element 153 (rough mesh) located on the lower side being altered in the mesh size, it is possible to produce finer foam.

The air-liquid mixture obtained by mixing the content substance with the air mixed in the air-liquid mixing chamber 115 passes from the air-liquid mixing chamber 115 to the inside of the reduced-diameter part 143 and then circulates inside the foaming member 116, to thereby be foamed into bubbles.

The depressing head 107 includes: a head main unit 154; and an exterior cylindrical portion 155. The head main unit 154 and the exterior cylindrical portion 155 are formed as separate entities, and are fitted to each other. The head main unit 154 includes: a top wall portion 156; an attachment cylindrical portion 157; a fitting cylindrical portion 158; a covering wall portion 159; and a nozzle cylindrical portion 160.

The top wall portion 156 is arranged above the stem 105.

The attachment cylindrical portion 157 extends downwardly from the top wall portion 156 and is attached to the stem 105. The attachment cylindrical portion 157 is arranged coaxially with the axis line O, and is fitted onto the upper end portion of the upper stem 139. A lower end portion of the attachment cylindrical portion 157 is inserted into the guide cylindrical portion 120. The attachment cylindrical portion 157 is freely movable in the guide cylindrical portion 120 in the up-down direction.

On an inner circumferential surface of an upper end portion of the attachment cylindrical portion 157, restricting ribs 161 are provided that protrude inwardly in the radial direction. The restricting rib 161 is formed in a plate shape that extends in the up-down direction. Upper end portions of the restricting ribs 161 are connected to the top wall portion 156. Lower end portions of the restricting ribs 161 are in contact with the upper end portion of the upper stem 139.

The fitting cylindrical portion 158 protrudes downwardly from the top wall portion 156, and is arranged coaxially with the axis line O. The fitting cylindrical portion 158 surrounds the upper end portion of the attachment cylindrical portion 157 from the outer side in the radial direction.

The nozzle cylindrical portion 160 extends from the attachment cylindrical portion 157 outwardly in the radial direction, and protrudes further outwardly in the radial direction than the fitting cylindrical portion 158. The inside of the nozzle cylindrical portion 160 is in communication with the inside of the stem 105 through the inside of the upper end portion of the attachment cylindrical portion 157. In a protrusion end of the nozzle cylindrical portion 160, the discharge hole 106 is provided. Hereinafter, in the radial direction, a direction in which the nozzle cylindrical portion 160 extends is referred to as forward-rearward direction. A direction in which the discharge hole 106 opens along the forward-rearward direction (the right side in FIG. 8) is referred to as forward direction while a direction opposite thereto (the left side in FIG. 8) is referred to as rearward direction.

The covering wall portion 159 extends downwardly from an outer circumferential edge of the top wall portion 156. The covering wall portion 159 is formed in a C shape that opens toward the forward direction in a planar view when the foamer dispenser 101 is seen in the up-down direction. A circumferential end portion of the covering wall portion 159 is connected to a side surface of the nozzle cylindrical portion 160 along the circumferential direction. The covering wall portion 159 covers the fitting cylindrical portion 158 and the upper end portion of the attachment cylindrical portion 157 from the outer side in the radial direction.

The exterior cylindrical portion 155 is provided at a position below the top wall portion 156. An upper edge of the exterior cylindrical portion 155 is in contact with a lower surface of the top wall portion 156. An upper end portion of the exterior cylindrical portion 155 is fitted into the fitting cylindrical portion 158. In an upper end portion of the exterior cylindrical portion 155, an annular protruded strip portion 162 is provided that protrudes outwardly in the radial direction. The protruded strip portion 162 is fitted (undercut-fitted or the like) to an inner circumferential surface of the fitting cylindrical portion 158.

The exterior cylindrical portion 155 surrounds the attachment cylindrical portion 157 and the guide cylindrical portion 120 from the outer side in the radial direction. The inside of the exterior cylindrical portion 155 is communicable with the inside of the cylinder for air 114 through the inside of the guide cylindrical portion 120. A lower end portion of the exterior cylindrical portion 155 is arranged at a position equivalent in the up-down direction to that of the lower end portion of the attachment cylindrical portion 157. The lower end portion of the exterior cylindrical portion 155 surrounds the upper end portion of the guide cylindrical portion 120 from the outer side in the radial direction.

On the lower end portion of the exterior cylindrical portion 155, an outer guide protrusion 163 is provided that protrudes inwardly in the radial direction. The outer guide protrusion 163 is formed in an annular shape. In a state before the depressing head 107 is depressed, the outer guide protrusion 163 faces the inner guide protrusion 123 in the radial direction and is close to the inner guide protrusion 123.

In the upper end portion of the exterior cylindrical portion 155, intake holes 164, 165 are formed. The intake holes 164, 165 penetrate through the exterior cylindrical portion 155 in the radial direction, and open toward the upward direction. Hereinafter, the intake hole 164 is referred to also as first intake hole 164 while the intake hole 165 is referred to also as second intake hole 165.

Two first intake holes 164 are arranged in sections of the exterior cylindrical portion 155 that are located on both sides of the left-right direction, out of the radial directions, that is orthogonal to the forward-rearward direction. The two first intake holes 164 are formed so as to have equivalent shape and size. The first intake hole 164 is formed so as to have a rectangular shape in a side view when the foamer dispenser 101 is seen in the left-right direction.

Here, in opening circumferential edges of the intake holes 164, 165 in the outer circumferential surface of the exterior cylindrical portion 155, receding sections 166 are formed that recede inwardly in the radial direction and are continuous to the intake holes 164, 165. The receding section 166 is arranged in a part, of the opening circumferential edge of the first intake hole 164 in the outer circumferential surface of the exterior cylindrical portion 155, that continues to the first intake hole 164 from below. The receding section 166 is formed in a rectangular shape when seen in a side view. The size of the receding section 166 in the circumferential direction is equivalent to that of the first intake hole 164 in the circumferential direction.

The first intake holes 164 are covered with the fitting cylindrical portion 158 and the covering wall portion 159 from the outer side in the radial direction. The first intake hole 164 is in communication with the outside of the foamer dispenser 101 through the receding section 166.

The second intake hole 165 is located on the forward side in the exterior cylindrical portion 155. The second intake hole 165 is arranged so that the position of the second intake hole 165 in the circumferential direction coincides with that of the nozzle cylindrical portion 160.

Into the second intake hole 165, the nozzle cylindrical portion 160 is inserted from above. The nozzle cylindrical portion 160 extends forwardly from the second intake hole 165 and protrudes further outwardly in the radial direction than the exterior cylindrical portion 155. A size of the second intake hole 165 in the circumferential direction is equivalent to that of the nozzle cylindrical portion 160 in the circumferential direction. A side surface of the nozzle cylindrical portion 160 is locked between parts of an inner circumferential edge of the second intake hole 165 that face inwardly in the circumferential direction.

The second intake hole 165 is larger than the nozzle cylindrical portion 160 in the up-down direction. Therefore, between a lower surface of the nozzle cylindrical portion 160 and a part of the inner circumferential edge of the second intake hole 165 that faces upwardly, a gap is provided in the up-down direction.

On an inner circumferential surface of the exterior cylindrical portion 155, guide ribs 167, 168 are protrudingly provided that extend in the up-down direction.

When the depressing head 107 is depressed obliquely, the guide ribs 167, 168 are capable of slidably contacting the guide cylindrical portion 120 (the inner guide protrusion 123 of the guide cylindrical portion 120, in the example shown in the figure) from the outer side in the radial direction. The guide ribs 167, 168 are arranged in sections of the exterior cylindrical portion 155 that are opposite to each other in the radial direction across the guide cylindrical portion 120.

Hereinafter, the guide rib 167 is referred to also as first guide rib 167 while the guide rib 168 referred to also as second guide rib 168.

The first guide ribs 167 are arranged on a forward section of the exterior cylindrical portion 155. To be more specific, the first guide ribs 167 are arranged in a section beneath the second intake hole 165. Upper end portions of the first guide ribs 167 are located beneath the inner circumferential edge of the second intake hole 165. Lower end portions of the first guide ribs 167 are connected to the outer guide protrusion 163. The first guide ribs 167 extend straightly in the up-down direction, and are connected smoothly to a surface of the outer guide protrusion 163.

Although not specifically illustrated, three first guide ribs 167 are spaced in the circumferential direction in the forward section of the exterior cylindrical portion 155. The three first guide ribs 167 are arranged at regular intervals in the circumferential direction. Of the three first guide ribs 167, the one positioned in the middle in the circumferential direction is arranged right in the forward direction with respect to the axis line O.

The second guide ribs 168 are arranged in a rear section, which is a section located on a side opposite to the first guide ribs 167 in the radial direction. The second guide rib 168 is formed over the whole length of the rear section of the exterior cylindrical portion 155 in the up-down direction. Lower end portions of the second guide ribs 168 are connected to the outer guide protrusion 163. The second guide ribs 168 extend straightly in the up-down direction, and are connected smoothly to a surface of the outer guide protrusion 163.

Although not specifically illustrated, two second guide ribs 168 are spaced in the circumferential direction in the rear section of the exterior cylindrical portion 155. The two second guide ribs 168 are arranged to avoid a part of the exterior cylindrical portion 155 that is located right in the rear direction with respect to the axis line O.

On the top wall portion 156 of the head main unit 154, pairs of lock portions 169 are provided that protrude downwardly and are spaced from each other in the circumferential direction. The pairs of lock portions 169 are each locked between parts of an inner circumferential edge of each of the intake holes 164, 165 that face inwardly in the circumferential direction.

The pairs of lock portions 169 are each provided in each of the two first intake holes 164, and are arranged in parts of the top wall portion 156 that are located on both sides in the left-right direction. The lock portion 169 is formed in a plate shape that extends in the radial direction. The lock portion 169 extends straightly along the left-right direction when seen in a planar view. Surfaces of the paired lock portions 169 that face in the circumferential direction are locked in the inner circumferential edge of the first intake hole 164, and are close to or in contact with the inner circumferential edge.

The lock portion 169 connects between the attachment cylindrical portion 157 and the fitting cylindrical portion 158. To be more specific, an end section of the lock portion 169 on the inner side in the radial direction is connected to the attachment cylindrical portion 157 while an end section thereof on the outer side in the radial direction is connected to the fitting cylindrical portion 158.

Although not specifically illustrated, the size of the lock portion 169 in the up-down direction is smaller in a stepwise manner from the inner side to the outer side in the radial direction. Of the lock portion 169, an in-cylinder portion, which is located inner in the radial direction than the exterior cylindrical portion 155 in the radial direction, protrudes further downwardly than a part that is located outer in the radial direction than the in-cylinder portion and that is arranged in the first intake hole 164. The in-cylinder portion supports the exterior cylindrical portion 155 from the inner side in the radial direction. The in-cylinder portion is close to or in contact with the inner circumferential surface of the exterior cylindrical portion 155 from the inner side in the radial direction.

The top wall portion 156 is provided with a plurality of support plate portions 170 that protrude downwardly and extend in the radial direction. The support plate portions 170 are arranged in the circumferential direction. The support plate portions 170 are provided radially about the axis line O when seen in a planar view, and are arranged at intervals over the whole length in the circumferential direction. The support plate portions 170 are arranged at positions that avoid, in the circumferential direction, the nozzle cylindrical portion 160 and a section between each pair of lock portions 169.

End sections of the support plate portions 170 on the inner side in the radial direction are connected to the attachment cylindrical portion 157. End sections of the support plate portions 170 on the outer side in the radial direction support the exterior cylindrical portion 155 from the inner side in the radial direction, and are close to or in contact with the inner circumferential surface of the exterior cylindrical portion 155 from the inner side in the radial direction. The support plate portions 170 are spaced in the circumferential direction, to thereby constitute a plate portion train. The exterior cylindrical portion 155 is fitted onto the plate portion train.

In the foamer dispenser 101 with the structure as described above, when the depressing head 107 is depressed to move the stem 105 downwardly, the content substance in the container main unit 102 is transferred and mixed with air to form an air-liquid mixture, which is foamed to be in a bubble form and is then discharged from the discharge hole 106.

In using the discharge vessel 110, the restricting member 124 is detached from the attachment cap 104, and then the depressing head 107 is depressed with respect to the container main unit 102. Thereby, the stem 105 and the piston for liquid 111 are depressed in a unified manner.

At this time, the inner slide cylinder 146 of the piston for air 113 relatively moves on the external side of the part of the lower stem 138 that corresponds to the piston for air, and the upper end portion of the inner slide cylinder 146 slides on the inner circumferential surface of the upper stem 139. Therefore, the position of the piston for air 113 in the up-down direction is maintained. As a result, between the flange portion 140 of the lower stem 138 and the lower edge of the inner slide cylinder 146 of the piston for air 113, a communication gap is provided that communicates between the air introduction passage 152 and the lower chamber of the cylinder for air 114. Thereby, the lower chamber and the air-liquid mixing chamber 115 are brought into communication with each other. Furthermore, at this time, the valve member 135 is also moved downwardly. Then, the lower valve body 137 of the valve member 135 is seated on the tapered cylindrical portion 127 of the cylinder for liquid 112, to thereby close the lower opening section of the cylinder for liquid 112.

When the depressing head 107 is depressed until the lower edge of the upper stem 139 is brought into contact with the third guide ribs 131 of the inner slide cylinder 146 of the piston for air 113, the piston for air 113 is moved downwardly together with the depressing head 107, and the outer slide cylinder 145 of the piston for air 113 slides downwardly on the inner circumferential surface of the circumferential wall of the cylinder for air 114.

At this time, the valve body 149, which is in contact with the connector plate 147 of the piston for air 113 from below, remains in close contact with the lower surface of the connector plate 147, and hence, the air hole 148 is closed. As a result, air in the lower chamber of the cylinder for air 114 is compressed, and the air is transferred to the air-liquid mixing chamber 115 through the communication gap and the air introduction passage 152. Furthermore, at this time, in a state with the lower opening section of the cylinder for liquid 112 being closed, the piston for liquid 111 is moved downwardly while the biasing member 134 is being compressed to deform, to thereby space the upper valve body 136 of the valve member 135 away from the valve seat portion (small-diameter section 130) of the piston for liquid 111. This brings the inside of the cylinder for liquid 112 and the inside of the upper section of the lower stem 138 into communication with each other. Then, the content substance in the cylinder for liquid 112 flows through the inner side of the valve seat portion and the outer side of the upper valve body 136, and presses up the liquid discharge valve 151. Then, through the inner side of the valve seat 141, the content substance is transferred to the air-liquid mixing chamber 115.

As described above, with the depressing head 107 being depressed, the air and the content substance are separately transferred to the air-liquid mixing chamber 115, where they are joined together and mixed. The obtained air-liquid mixture is transferred to the foaming member 116, and passes through the mesh body of the lower foaming element 153 and the mesh body of the upper foaming element 153 in this order. This foams the air-liquid mixture into a bubble form, which flows through the nozzle cylindrical portion 160 and is discharged from the discharge hole 106.

After that, when the depressing of the depressing head 107 is released, the piston for liquid 111 is pressed upwardly by the elastic restoring force of the biasing member 134. As a result, the valve seat portion of the piston for liquid 111 is brought into contact with the upper valve body 136 of the valve member 135, to thereby close the upper valve body 136. This stops the transfer of the content substance to the air-liquid mixing chamber 115. Furthermore, the lower valve body 137 is detached from the lower opening section of the cylinder for liquid 112. As a result, the inside of the container main unit 102 and the inside of the cylinder for liquid 112 are brought into communication with each other, and the content substance in the container main unit 102 flows into the cylinder for liquid 112. At this time, the inside of the container main unit 102 has a negative pressure. Therefore, through an introduction hole provided in a part of the cylinder for air 114 that is located above the outer slide cylinder 145, the air in the upper chamber of the cylinder for air 114 that is located above the piston for air 113 is introduced into the container main unit 102.

Furthermore, together with the piston for liquid 111 that rises as described above, the stem 105 and the depressing head 107 rise in a unified manner, to thereby bring the flange portion 140 of the lower stem 138 into contact with the lower edge of the inner slide cylinder 146 of the piston for air 113. This blocks the communication between the lower chamber of the cylinder for air 114 and the air-liquid mixing chamber 115 through the air introduction passage 152, to thereby stop the transfer of the air to the air-liquid mixing chamber 115. After that, with the piston for air 113 being pressed up by the elastic restoring force of the biasing member 134, the inside of the lower chamber has a negative pressure. This elastically deforms the valve body 149 of the piston for air 113 in the downward direction, to thereby open the air hole 148. As a result, through the air hole 148, the upper chamber of the cylinder for air 114, the inside of the guide cylindrical portion 120, and the inside of the exterior cylindrical portion 155, outside air is supplied from the outside of the container into the lower chamber of the cylinder for air 114.

According to the foamer dispenser 101 of the present embodiment as described above, either one of the outer circumferential surface of the insertion section of the discharge device 108 that is inserted into the guide portion 118 of the attachment cap 104 (to be more specific, the attachment cylindrical portion 157, the lower portion of the upper stem 139, and the inner slide cylinder 146 of the piston for air 113) and the inner circumferential surface of the guide portion 118 of the attachment cap 104 (to be more specific, the guide cylindrical portion 120, and the insertion cylinder 122 of the ceiling wall portion 119) is provided with the guide ribs 125 that are slidable in the up-down direction with respect to the other. Therefore, remarkable effects as follows will be produced.

Even if, when the depressing head 107 is depressed, the discharge device 108 does not move straightly toward the downward direction but is to move in a direction that crosses the up-down direction, the guide ribs 125 provided on one of the two move in the up-down direction while sliding on the circumferential surface of the other. As a result, it is possible to inhibit the discharge device 108 from being depressed obliquely forwardly or rearwardly instead of straightly downwardly and from shaking with respect to the attachment cap 104.

From above, when the depressing head 107 is depressed, it is possible to inhibit the oblique depressing or shaking (hereinafter, referred to shortly as shaking or the like) of the discharge device 108 with respect to the attachment cap 104, and hence, to stabilize the positional relationship between the discharge device 108 and the attachment cap 104 in the radial direction. This stabilizes the operation of depressing. Therefore, operability of the foamer dispenser 101 is enhanced.

As guide ribs 125, either one of the inner slide cylinder 146 of the piston for air 113 and the ceiling wall portion 119 of the attachment cap 104 is provided with the third guide ribs 131 that are slidable in the up-down direction with respect to the other. Therefore, shaking or the like when the piston for air 113 of the discharge device 108 is moved in the up-down direction with respect to the ceiling wall portion 119 of the attachment cap 104 is inhibited. Consequently, the aforementioned effect is further enhanced.

Furthermore, in the ceiling wall portion 19 of the attachment cap 104, the insertion cylinder 122 into which the inner slide cylinder 146 of the piston for air 113 is inserted is provided. Therefore, it is possible to obtain a length along the up-down direction that is sufficiently long to allow the insertion cylinder 122 and the inner slide cylinder 146 to contact each other. Consequently, the aforementioned effect of inhibiting shaking or the like of the discharge device 108 is further enhanced.

Furthermore, in the present embodiment, the third guide ribs 131 are provided on the inner slide cylinder 146 of the piston for air 113. Here, through the inner slide cylinder 146 of the piston for air 113, the stem 105 is inserted. The inner slide cylinder 146 together with the stem 105 is inserted into the ceiling wall portion 119 of the attachment cap 104. In the case of this structure, it is possible to obtain a more sufficient length of the third guide rib 131 along the up-down direction. Consequently, the aforementioned effect of inhibiting shaking or the like of the discharge device 108 is still further enhanced.

Furthermore, as guide ribs 125, the fourth guide ribs 132, which are slidable in the up-down direction with respect to the other, are provided with either one of the attachment cylindrical portion 157 of the depressing head 107 and the guide cylindrical portion 120 of the attachment cap 104. Therefore, shaking or the like when the depressing head 107 of the discharge device 108 is moved in the up-down direction with respect to the guide cylindrical portion 120 of the attachment cap 104 is inhibited. Consequently, the aforementioned effect is still further enhanced.

Furthermore, in this case, the third guide rib 131 and the fourth guide rib 132 are allowed to be located in different sections along the up-down direction (allowed to be spaced in the up-down direction). Therefore, it is possible to inhibit the aforementioned shaking or the like of the discharge device 108 especially remarkably.

Furthermore, the inner circumferential surface of the exterior cylindrical portion 155 is protrudingly provided with the guide ribs 167, 168. Therefore, for example, when the depressing head 107 is depressed obliquely, it is possible to make the guide cylindrical portion 120 slidable in the up-down direction on the guide ribs 167, 168, and the guide cylindrical portion 120 makes it possible to restrict the displacement of the exterior cylindrical portion 155 in the radial direction. As a result, it is possible to stabilize the position of the exterior cylindrical portion 155 in the radial direction, and hence, to inhibit the wobbling of the depressing head 107 with respect to the attachment cap 104. Furthermore, it is possible to stabilize the positional relationship between the exterior cylindrical portion 155 and the head main unit 154 in the radial direction. Therefore, even if the head main unit 154 and the exterior cylindrical portion 155 are formed as separate entities, it is possible to secure the operability of the foamer dispenser 101.

Furthermore, the guide ribs 167, 168 are located in the sections of the exterior cylindrical portion 155 that are opposite to each other in the radial direction across the guide cylindrical portion 120. Therefore, when the depressing head 107 is depressed obliquely, it is possible to bring the guide ribs 167, 168 into slidable contact with the guide cylindrical portion 120 from both outer sides in the radial direction, and hence, to further stabilize the position of the exterior cylindrical portion 155 in the radial direction.

Furthermore, the first guide rib 167 and the second guide rib 168 are arranged in the sections of the exterior cylindrical portion 155 that are located on both sides in the forward-rearward direction. Therefore, when the depressing head 107 is depressed obliquely, the first guide rib 167 and the second guide rib 168 make it possible to stabilize the position of the exterior cylindrical portion 155 in the forward-rearward direction. Accordingly, even if, when the depressing head 107 is depressed, a front end of the nozzle cylindrical portion 160 is depressed to produce an external force that may incline the depressing head 107 in the forward direction, it is possible to effectively inhibit the wobbling of the depressing head 107 with respect to the attachment cap 104, and also to securely stabilize the positional relationship between the exterior cylindrical portion 155 and the head main unit 154 in the forward-rearward direction.

Furthermore, because the intake holes 164, 165 are formed in the upper end portion of the exterior cylindrical portion 155, the following effects are obtained.

In a foamer dispenser in which the exterior cylindrical portion 155 is not provided with the intake holes 164, 165 as is the conventional case, when the depressing head 107 moves back upwardly, outside air is sucked into the exterior cylindrical portion 155 through the gap between the inner circumferential surface of the exterior cylindrical portion 155 and the outer circumferential surface of the guide cylindrical portion 120 (hereinafter, referred to as "cylinder-cylinder gap"), and is then drawn into the cylinder for air 114 through the inside of the guide cylindrical portion 120. Here, if foreign matter such as water is attached to the outer surface of the attachment cap 104, there is a possibility that, when the depressing head 107 moves back upwardly, the foreign matter together with the air is sucked into the exterior cylindrical portion 155 through the cylinder-cylinder gap and intrudes into the cylinder for air 114.

On the other hand, in the foamer dispenser 101 of the present embodiment, the intake holes 164, 165 are formed in the upper end portion of the exterior cylindrical portion 155. Therefore, when the depressing of the depressing head 107 is released to cause the inside of the cylinder for air 114 to have a negative pressure, it is possible to suck the outer air into the exterior cylindrical portion 155 through the intake holes 164, 165. As a result, sucking of outside air into the exterior cylindrical portion 155 through the cylinder-cylinder gap is inhibited, and hence, sucking of foreign matter together with the outside air into the exterior cylindrical portion 155 through the cylinder-cylinder gap is inhibited. Therefore, it is possible to inhibit the intrusion of foreign matter into the cylinder for air 114.

Furthermore, because the intake holes 164, 165 are formed in the upper end portion of the exterior cylindrical portion 155, it is possible to maintain a low influence that the intake holes 164, 165 have on the appearance of the depressing head 107.

Furthermore, the intake holes 164, 165 open toward the upward direction. Therefore, for example when the exterior cylindrical portion 155 is molded with a mold, it is possible to remove the mold with ease, and hence, to make it easy to form the foamer dispenser 101 with simplicity.

Furthermore, on the opening circumferential edges of the intake holes 164, 165 in the outer circumferential surface of the exterior cylindrical portion 155, the receding sections 166 are formed. Therefore, foreign matter such as water is unlikely to intrude. Furthermore, it is possible to introduce the outside air into the intake holes 164, 165 through the receding sections 166, and hence, to effectively suck the outside air into the exterior cylindrical portion 155.

Furthermore, the head main unit 154 is provided with the covering wall portion 159. Therefore, it is possible to inhibit the intake holes 164, 165 from being exposed to the outside, and hence, to maintain the appearance of the foamer dispenser 101 favorable.

Furthermore, the top wall portion 156 is provided with the pairs of lock portions 169. Therefore, when the head main unit 154 and the exterior cylindrical portion 155 are to rotate relatively in the circumferential direction, the paired lock portions 169 are locked in the inner circumferential edges of the intake holes 164, 165, to thereby make it possible to restrict the rotation. Furthermore, when the exterior cylindrical portion 155 is to be deformed so as to narrow the intake holes 164, 165 in the circumferential direction, the paired lock portions 169 are locked in the inner circumferential edges of the intake holes 164, 165, to thereby make it possible to restrict the deformation as well.

Furthermore, the pairs of lock portions 169 are spaced in the circumferential direction. Therefore, it is possible to securely communicate between the outer portion and inner portion of the exterior cylindrical portion 155 through the sections of the intake holes 164, 165 that are located between the pairs of lock portions 169, while the rotation and deformation as described above are being restricted. Consequently, it is possible to securely suck the outside air into the exterior cylindrical portion 155 through the intake holes 164, 165.

In the present embodiment, the top wall portion 156 is provided with the fitting cylindrical portion 158 which protrudes downwardly and onto which the attachment cylindrical portion 157 is fitted, and lock portions 169 connect between the attachment cylindrical portion 157 and the fitting cylindrical portion 158. In this case, when the paired lock portions 169 are locked in the inner circumferential edges of the intake holes 164, 165, it is possible to support both ends of the lock portions 169 in the radial direction by the attachment cylindrical portion 157 and the fitting cylindrical portion 158, and hence, to effectively restrict the rotation and the deformation.

Furthermore, on the top wall portion 156, the support plate portions 170 are arranged. The inner ends of the support plate portions 170 in the radial direction are connected to the attachment cylindrical portion 157 while the outer ends of the support plate portions 170 support the exterior cylindrical portion 155 from the inner side in the radial direction. Therefore, for example, when the exterior cylindrical portion 155 is to shake in the radial direction with respect to the head main unit 154, it is possible to cause the top wall portion 156 and the attachment cylindrical portion 157 to support the exterior cylindrical portion 155 via the support plate portions 170. As a result, it is possible to attach the exterior cylindrical portion 155 tightly to the head main unit 154, and hence, for example, to inhibit shaking between the exterior cylindrical portion 155 and the head main unit 154.

Furthermore, the top wall portion 156 is provided with the fitting cylindrical portion 158. Therefore, it is possible to sandwich the exterior cylindrical portion 155 between the fitting cylindrical portion 158 and the support plate portions 170 in the radial direction, and hence, to attach the exterior cylindrical portion 155 further tightly to the head main unit 154.

Furthermore, the in-cylinder portions of the lock portions 169 that are located on the inner side in the radial direction than the exterior cylindrical portion 155 support the exterior cylindrical portion 155 from the inner side in the radial direction. Therefore, it is possible to support the exterior cylindrical portion 155 from the inner side in the radial direction not only by the support plate portions 170 but also by the in-cylinder portions of the lock portions 169, and hence, to attach the exterior cylindrical portion 155 further tightly to the head main unit 154.

The present invention is not limited to the aforementioned embodiment, and various modifications can be made without departing from the spirit or scope of the present invention.

For example, in the aforementioned embodiment, the third guide ribs 131 are formed on the inner slide cylinder 146 so as to be slidable in the up-down direction with respect to the insertion cylinder 122 of the ceiling wall portion 119. However, the present invention is not limited to this. The third guide ribs 131 may be formed on the insertion cylinder 122 so as to be slidable in the up-down direction with respect to the inner slide cylinder 146.

Furthermore, the fourth guide ribs 132 are formed on the guide cylindrical portion 120 so as to be slidable in the up-down direction with respect to the attachment cylindrical portion 157. However, the present invention is not limited to this. The fourth guide ribs 132 may be formed on the attachment cylindrical portion 157 so as to be slidable in the up-down direction with respect to the guide cylindrical portion 120.

Furthermore, the guide ribs 125 may be formed on the lower portion of the upper stem 139 so as to be slidable in the up-down direction with respect to the guide portion 118.

The restricting member 124 may be not provided.

In the aforementioned embodiment, the first guide rib 167 and the second guide rib 168 are provided. However, the present invention is not limited to this. For example, guide ribs may be arranged on the sections of the inner circumferential surface of the exterior cylindrical portion 155 that are located on both sides in the left-right direction.

Furthermore, the guide ribs 167, 168 may not be arranged on the sections of the exterior cylindrical portion 155 that are opposite to each other in the radial direction across the guide cylindrical portion 120. In addition, the guide ribs 167, 168 may not be provided.

Furthermore, the in-cylinder portions of the lock portions 169 may not support the exterior cylindrical portion 155 from the inner side in the radial direction. In addition, the lock portions 169 may not connect between the attachment cylindrical portion 157 and the fitting cylindrical portion 158. Furthermore, the lock portion 169 may not be provided.

Furthermore, the nozzle cylindrical portion 160, the fitting cylindrical portion 158, and the covering wall portion 159 may not be provided.

In this case, for example, the discharge hole 106 may be formed of a through-hole that penetrates through the exterior cylindrical portion 155. Furthermore, the support plate portions 170 may not be provided.

Furthermore, the receding sections 166 may not be provided.

Furthermore, in the aforementioned embodiment, the first intake holes 164 and the second intake hole 165 are provided. However, the present invention is not limited to this. For example, as intake hole(s), at least either the first intake holes or the second intake hole may be provided.

Furthermore, the intake holes 164, 165 may not be provided.

Otherwise, it is appropriately possible to replace the constituent elements of the embodiments with known constituent elements without departing from the spirit or scope of the present invention. Furthermore, the aforementioned modifications may be appropriately combined.

For example, in the foamer dispenser 10 according to the first embodiment, either one of the inner slide cylinder 32 and the ceiling wall portion 16 may be provided with a third guide rib that is slidable in the up-down direction with respect to the other. Furthermore, either one of the attachment cylindrical portion 44 and the guide cylindrical portion 17 may be provided with a fourth guide rib that is slidable in the up-down direction with respect to the other.

INDUSTRIAL APPLICABILITY

According to the present invention, it is possible to provide a foamer dispenser that is capable of inhibiting the intrusion of foreign matter such as water into the cylinder for air.

Furthermore, according to the present invention, it is possible to provide a foamer dispenser in which the exterior cylindrical portion can be attached tightly to the head main unit.

Furthermore, according to the present invention, it is possible to provide a foamer dispenser in which oblique depressing of the depressing head can be restricted to stabilize the positional relationship between the exterior cylindrical portion and the head main unit in the radial direction.

Furthermore, it is possible to provide a foamer dispenser in which, when the depressing head is depressed, the discharge device can be inhibited from being obliquely depressed or from shaking with respect to the attachment cap.

REFERENCE SIGNS LIST

1: container main unit
1*a*: mouth portion
10: foamer dispenser
11: attachment cap
12: stem
13: discharge device
14: nozzle hole
15: depressing head
16: ceiling wall portion
17: guide cylindrical portion
25: piston for liquid
26: cylinder for liquid
27: piston for air
28: cylinder for air
29: air-liquid mixing chamber
30: foaming member
41: head main unit
42: exterior cylindrical portion
43: top wall portion
44: attachment cylindrical portion
45: fitting cylindrical portion
46: covering wall portion
47: nozzle cylindrical portion
51*a*: first intake hole
51*b*: second intake hole
52: receding section
53*a*: first guide rib
53*b*: second guide rib
54: lock portion
54*a*: in-cylinder portion
55: support plate portion
101: foamer dispenser
102: container main unit
103: mouth portion
104: attachment cap
105: stem
106: discharge hole
107: depressing head
108: discharge device
111: piston for liquid
112: cylinder for liquid
113: piston for air
114: cylinder for air
115: air-liquid mixing chamber
116: foaming member
118: guide portion
119: ceiling wall portion
120: guide cylindrical portion
122: insertion cylinder
125: guide rib
131: third guide rib
132: fourth guide rib
146: inner slide cylinder
156: top wall portion
157: attachment cylindrical portion

The invention claimed is:

1. A foamer dispenser, comprising:
an attachment cap that is attached to a mouth portion of a container main unit in which a content substance is contained;
a discharge device having a stem that is erected through the attachment cap so as to be movable downwardly while being biased upwardly; and
a depressing head which is attached to the stem and in which a nozzle hole is formed, wherein:
the discharge device includes:
a piston for liquid that is linked to the stem;
a cylinder for liquid in which the piston for liquid is contained so as to be freely slidable in an up-down direction;
a piston for air that is linked to the stem;
a cylinder for air in which the piston for air is contained so as to be freely slidable in the up-down direction;
an air-liquid mixing chamber that mixes liquid from the cylinder for liquid with air from the cylinder for air; and
a foaming member that is disposed between the air-liquid mixing chamber and the nozzle hole and foams an air-liquid mixture from the air-liquid mixing chamber;
the attachment cap includes:
an annular ceiling wall portion that is arranged above the mouth portion; and
a guide cylindrical portion that is erected on the ceiling wall portion;
the depressing head includes:
a head main unit having a top wall portion arranged above the stem, and an attachment cylindrical portion that extends downwardly from the top wall portion and is attached to the stem; and
an exterior cylindrical portion that is provided beneath the top wall portion and surrounds the attachment cylindrical portion and the guide cylindrical portion from an outer side in a radial direction;
an inside of the exterior cylindrical portion is communicable with an inside of the cylinder for air through an inside of the guide cylindrical portion;
the head main unit and the exterior cylindrical portion are formed as separate entities and are fitted to each other;
in an upper end portion of the exterior cylindrical portion, an intake hole is formed that penetrates through the exterior cylindrical portion in the radial direction and opens toward an upward direction; and
a receding section is formed in an outer circumferential surface of the exterior cylindrical portion, the receding section receding inwardly in the radial direction to form a thin wall part of the exterior cylindrical portion having a thickness in the radial direction thinner than a thickness in the radial direction of other sections of the exterior cylindrical portion, the receding section being arranged adjacent the intake hole, and being in communication with the intake hole.

2. The foamer dispenser according to claim 1,
wherein the head main unit is provided with a covering wall portion that extends downwardly from the top wall portion and covers the intake hole from an outer side in the radial direction.

3. The foamer dispenser according to claim 2,
wherein the top wall portion is provided with a pair of lock portions that protrude downwardly, are spaced in a circumferential direction, and are locked between parts of an inner circumferential edge of the intake hole that face inwardly in the circumferential direction.

4. The foamer dispenser according to claim 1, wherein the top wall portion is provided with a pair of lock portions that protrude downwardly, are spaced in a circumferential direction, and are locked between parts of an inner circumferential edge of the intake hole that face inwardly in the circumferential direction.

5. The foamer dispenser according to claim 1, wherein the head main unit further has a fitting cylindrical portion which protrudes downwardly from the top wall portion and surrounds an upper end portion of the attachment cylindrical portion from the outer side in the radial direction, and into which the upper end portion of the exterior cylindrical portion is fitted.

* * * * *